US006102162A

United States Patent [19]

Teicher

[11] Patent Number: 6,102,162

[45] Date of Patent: Aug. 15, 2000

[54] AUTOMATED SELF-SERVICE CAFETERIA SYSTEM

[76] Inventor: Mordechai Teicher, 9 Gordon Street, Kfar Saba 44260, Israel

[21] Appl. No.: 09/168,521

[22] Filed: Oct. 8, 1998

[51] Int. Cl.[7] ..... E04H 3/04

[52] U.S. Cl. ..... 186/39; 221/2; 235/383

[58] Field of Search ..... 186/38, 39; 221/69, 221/2, 3, 7, 8; 235/383, 381; 414/274

[56] References Cited

U.S. PATENT DOCUMENTS

| | | | |
|---|---|---|---|
| 1,872,110 | 8/1932 | Brand | 186/38 |
| 4,108,363 | 8/1978 | Susumu | 235/383 |
| 4,414,467 | 11/1983 | Gould et al. | 235/381 |
| 4,415,065 | 11/1983 | Sandstedt | 235/383 |
| 4,553,211 | 11/1985 | Kawasaki et al. . | |
| 4,629,090 | 12/1986 | Harris et al. | 221/7 |
| 4,791,411 | 12/1988 | Staar | 221/2 |
| 5,728,999 | 3/1998 | Teicher | 235/381 |

*Primary Examiner*—Robert P. Olszewski
*Assistant Examiner*—Bryan Jaketic

[57] ABSTRACT

A free-access vending system for use in a cafeteria or similar dining facility, which permits patrons to freely take food items from cafeteria self-service units and to pay for what they take at the time of taking with a payment card or similar instrument, via an automated payment handler. The automated payment handler not only receives payment from patrons, but also has item sensing devices to detect food items as they are removed, thereby eliminating the need for staff personnel to account for food items taken and receive payment from patrons or charge their accounts for meals. Food items removed from the cafeteria self-service units may be replenished directly and conveniently from the kitchen as patrons take them. Packaged food items, such as beverages, may be stored within the cafeteria self-service unit and reloaded independently of freshly-prepared food items, and the stocks thereof optionally maintained by outside personnel. The free-access item sensing devices of the cafeteria self-service unit can be used to detect and identify not only food items taken by patrons, but also the replenished food items. A central information and control system thereby maintains complete tracking and time flow of food items to provide not only accounting and inventory information and reporting to management, but also flow analysis and food item purchasing patterns for patron assistance, scheduling, menu preparation, and the like, and to aid in increasing the real-time operation of the cafeteria while further reducing staff personnel requirements.

16 Claims, 15 Drawing Sheets

1002 1004 1006 1008 1010 1012

Cumulative Item Report for Week of October 4 - 9

| Item | Description | Qty Prep | Qty Sold | Price | Avg. Time |
|---|---|---|---|---|---|
| 120 | Mushroom Burger | 39 | 36 | $4.95 | 3:12 |
| 125 | Fish & Chips | 36 | 34 | $5.50 | 4:49 |
| 138 | Tuna Casserole | 38 | 34 | $4.75 | 4:02 |
| 156 | Roast Turkey | 41 | 37 | $5.95 | 3:57 |
| 172 | Lasagna | 29 | 25 | $4.95 | 3:50 |
| 174 | Baked Chicken | 42 | 38 | $5.95 | 5:27 |
| 188 | Fried Chicken | 44 | 40 | $5.75 | 3:54 |
| 192 | Hot Pastromi | 35 | 33 | $4.95 | 3:20 |
| 217 | Roast Beef | 37 | 34 | $6.95 | 4:32 |
| 220 | Veal Stew | 24 | 20 | $5.50 | 4:08 |
| 237 | Sirloin Tips | 40 | 38 | $5.59 | 4:20 |
| 286 | Cheese Ravioli | 40 | 37 | $4.50 | 3:39 |
| 436 | Garden Salad | 172 | 166 | $ .95 | 4:12 |
| 602 | Cole Slaw | 83 | 75 | $.95 | 4:37 |
| 802 | Apple Pie | 163 | 152 | $1.45 | 5:08 |
| 833 | Cake | 145 | 132 | $1.50 | 7:12 |

1014

330-A

FIG. 10.

AUTOMATED SELF-SERVICE CAFETERIA SYSTEM

FIELD AND BACKGROUND OF THE INVENTION

The present invention relates to vending systems in general, and, more particularly, to free-access vending systems for use in commercial dining facilities such as cafeterias.

A "free-access vending system" permits a customer to take items of merchandise at will from a designated self-service unit, and then automatically bills the customer for whatever items are taken after the customer takes them. This is in contrast to a conventional vending system, which requires prepayment, or a deposit sufficient to cover payment, for each item which the customer desires to purchase, prior to the taking of the item by the customer. A free-access vending system is disclosed in U.S. Pat. No. 5,728,999 to the present inventor, which is incorporated by reference for all purposes as if fully set forth herein. In particular, many details of implementing a free-access vending system such as that used in the present cafeteria self-service system are disclosed and described in U.S. Pat. No. 5,728,999. The terms "automatic", "automatically", "automated", and "automation" herein refer to any operation by a mechanical or electrical device which requires no human assistance or intervention. The terms "semi-automatic", "semi-automated", and "semi-automatically" refer to any operation by a mechanical or electrical device which requires some human assistance or intervention.

Vending systems, usually in the form of "vending machines", are commonly used in various locations to provide unattended points of sale for light foods such as beverages and snack items, but an important area of interest that currently is not properly addressed is in vending systems for the automation of cafeterias. The term "cafeteria" herein denotes any commercial or institutional dining facility serving a number of patrons, in which the patrons normally participate in the serving process, such as by directly taking items of food items from special designated self-service units for the storage and display of food items, herein referred to as "cafeteria self-service units". Examples of configurations to further elucidate the term "cafeteria" as used herein are given below. The term "patron" herein denotes any person who obtains food items at a cafeteria, including, but not limited to, paying customers, account holders, guests of such customers and account holders, and other guests.

Patron self-service eliminates many staffing requirements in a dining facility, leading to increased economy and efficiency. The cafeteria format is well-suited to reducing labor requirements, and many advances have been made in eliminating unnecessary labor. It has long been recognized, however, that there are aspects of cafeteria operation where even further labor reductions are possible. In particular, the task of receiving payment from patrons for food is an area of special interest because local regulations often prohibit personnel who handle food from also handling money. Such regulations require either additional personnel to handle payment or some from of automated payment handler. This is also the case for institutional cafeterias, such as those at schools, whose patrons may have pre-established payment accounts for their meals. The term "automated cafeteria" herein denotes any cafeteria or similar dining facility with one or more integrated systems for automation, including, but not limited to, an automated payment handler, an automated food item preparation system, and/or a food item inventory management system. Automated cafeterias come under the category of "cafeteria self-service systems", which term is used herein to denote the general classification of systems which are included in the present invention.

Cafeteria Configurations

There are a number of different configurations of a commercial or institutional dining facility which fall under the definition of "cafeteria" as used herein. For example, it is noted that the food item preparation that takes place in the kitchen depends on the requirements of the individual cafeteria. The kitchen of one particular cafeteria may have a full complement of kitchen equipment for cooking, roasting, baking, carving, ware-washing, etc., and be able to prepare food items from raw meats and vegetables, fresh-baked breads and pastries, and so forth. The kitchen of another cafeteria may have considerably less equipment and may rely more on packaged prepared food items (frozen, canned, etc.). The kitchen of still another cafeteria may have virtually no kitchen equipment at all—perhaps only equipment for warming or chilling food items prepared off-premises in a central facility and delivered to the cafeteria for serving, optionally on disposable plates and with disposable utensils which require no washing. In fact, the kitchen of a cafeteria may have no kitchen equipment whatsoever, and may be only a staging area for arranging food items to be placed into the cafeteria self-service unit. Thus, the term "kitchen" as used herein denotes any area, location, or facility from which food items can be placed into a cafeteria self-service unit, including, but not limited to, facilities with complete food supply operation capabilities, facilities with minimal food supply operation capabilities, and facilities with only food handling capabilities. The term "food supply operation" herein collectively denotes any action needed to make a food item ready for sale to a patron and to place that food item in a cafeteria self-service unit.

It is further noted that the configuration of the dining and patron self-service area can also be varied to suit the requirements of the individual cafeteria. The dining and patron self-service area of one particular cafeteria may have a dedicated room with tables and chairs, whereas the dining and patron self-service area of another cafeteria might be shared in common with other dining facilities, such as in a "food court" of a shopping mall. In this case, the cafeteria self-service unit would be on the outer periphery of a store front facing the food court, and patrons would select and purchase food items from the cafeteria self-service unit and carry them into the common part of the cafeteria self-service unit, where there are tables and chairs for dining. In still another variation, the dining and patron self-service area of a cafeteria might be substantially only an access point to the cafeteria self-service unit having no separate floor area, tables, or chairs, wherein patrons would select and purchase food items from the cafeteria self-service unit and carry the food items away, such as for consumption while walking. A cafeteria of this sort according to the present invention would be similar to the familiar "take out" store-front of food item vendors in urban areas.

In the minimal configuration, a cafeteria could have both a minimal kitchen and a minimal dining and patron self-service area, and be essentially a food item distribution point built around a cafeteria self-service unit, similar to a kiosk in an urban area or a concession stand at a park or fair.

All of these above configurations, and other combinations thereof without limitation, are considered to be cafeterias for purposes of applying the system according to the present invention.

Automated payment handlers for use in cafeterias are well-known in the prior art. For example, in July 1912, the Horn and Hardart company opened its first "Automat" in New York City. The overall operation of a prior art automated cafeteria, as exemplified by the "Automat", is illustrated in FIG. 1. An automated cafeteria is divided into two general areas, a dining and patron self-service area 102, and a kitchen 104, which are separated by a cafeteria self-service unit 106. In this example, a patron 108 selects from among a group of food items 116, 120, and 124, which are contained respectively in compartments 117, 121, and 125 of cafeteria self-service unit 106. A compartment 113 is shown as presently empty. Each of the compartments 113, 117, 121, and 125 has a respective patron access door 110, 114, 118, and 122. These patron access doors have a transparent section (possibly including the entire patron access door), so that patron 108 may view the food items in the respective compartments. In the prior art automated cafeteria exemplified by the "Automat", patron 108 selects a food item (116, 120, or 124) for purchase and then deposits coins 107 into conventional vending system-style slots 111, 115, 119, or 123 adjacent to the patron access door (114, 118, or 122) corresponding to the selected food item (116, 120, or 124). [In practice, prices of food items in the "Automat" were all fixed at multiples of 5¢, and conventional vending system-style slots 115, 119, or 123 were set to accept different numbers of 5¢ coins depending on the price of the particular food item.] When the proper amount of money is deposited, patron 108 can open the corresponding patron access door and remove the selected food item. The food items contained in the different compartments may cover a varied bill of fare. For example, food item 116 in compartment 117 might be an entre, whereas a food item 120 in compartment 121 might be a side order. Removed items are conveniently replenished from kitchen 104 by a staff person 126, who in this example opens an optional service access door 128 to place a food item 112 into empty compartment 113 of cafeteria self-service unit 106. [In practice at the "Automat", food items for replenishment were loaded onto a carousel (not shown) adjacent to cafeteria self-service unit 106, and then easily pushed into their respective compartments.]

Regardless of whether or not there is a service access door, however, there is always at least one "service access point", which herein denotes an opening or other entry point into a cafeteria self-service unit through which food items may be replenished without interfering with the patrons, such as directly from the kitchen. This is true both for a prior art automated cafeteria as well as for an automated cafeteria according to the present invention. In general, so that replenishment of the food items be possible without interfering with the patrons, it is necessary that there be at least two independent access points to the shelves of the cafeteria self-service unit, such that access through one of the access points does not conflict with access through another access point. The simplest way of insuring that two or more access points do not conflict is to have them access the shelves from substantially different geometrical directions, and the term "direction" regarding a shelf herein denotes a positional bearing with respect to that shelf characterized by a spatial or angular measure relative to that shelf. For example, the patrons access the cafeteria self-service unit from one direction, while the staff personnel access the cafeteria self-service unit from another direction. Each direction of access has a separate and independent access point. In the case of the prior art automated cafeteria, the access point for patrons has a patron access door for each compartment, as previously described.

Note that, according to the prior art vending system technology, each compartment (113, 117, 121, and 125) is intended to contain only a single food item (112, 116, 120, and 124). For example, even though food item 120 is a small side order, only a single such item is intended to be within a compartment, because once the patron has opened the compartment, there are no restrictions on what can be taken. Furthermore, the various compartments generally have only a few different heights and widths because it is difficult to freely adapt the vending machine-style patron access doors (110, 114, 118, and 122) to a large variety of sizes. Furthermore, the depths of the compartments generally must be identical. As a consequence, a small side order such as food item 120 can take up almost as much room (or just as much room) in cafeteria self-service unit 106 as does a large entre such as food item 116. As a consequence of these limitations, the prior art automated cafeteria makes inefficient use of the cafeteria self-service units.

One of the advantages of the prior art automated cafeteria over a conventional vending system is that replenishment of the food items can be accomplished without interfering with the patrons in their selection and purchase of the food items. As can be seen from FIG. 1, the replenishment operation by the staff person proceeds independently of the selection and purchase operations by the patron. In contrast, in a conventional vending system, to replenish items of merchandise, such as food items, it is normally necessary to temporarily suspend the availability of the conventional vending system for purchasing items of merchandise. This advantage of the prior art automated cafeteria is also featured in an automated cafeteria according to the present invention.

The benefits to the operator of an automated cafeteria are in reduced labor overhead, not only in handling payment, but also in reduced staffing requirements for handling the food items. Food items arc individually apportioned and presented so that once on display, the patron requires no assistance from staff personnel (such as a carver or other server) for self-service. The benefits to the patrons are in convenience, case of selection, economy, speed, and simplicity of purchasing. The concept of an automated cafeteria as exemplified by the "Automat" was readily accepted by the public, and at the height of its popularity there were about 40 "Automat" locations in New York. The "Automat" was commercially successful for a period of about 75 years from its introduction until its decline in the late 1980's and eventual closing in the early 1990's. Much of the decline in popularity and commercial viability of the "Automat" may be attributed to the limitations of the underlying coin-based automated payment handler technology, which is not well-suited to modern marketing styles and consumer expectations. One of the principal limitations of conventional coin-based vending system technology for application in a cafeteria is that coin-based payment is cumbersome and inconvenient, largely because inflation has badly eroded the buying power of conventional coinage. The purchase of an occasional drink or snack item from a conventional vending system which accepts coins may not be bothersome, but buying an entire meal at current prices using coins is completely inconvenient. This drawback also extends to the use of small bills, which are often accepted by conventional vending systems. Small bills arc also becoming less convenient to use because larger denominations are more frequently needed to cover everyday purchases. Another disadvantage of conventional vending systems is that they require a complete purchase cycle for each single item purchased, and this is inconvenient for patrons.

The use of modem charge cards, such as credit cards or debit cards, eliminates the inconvenience of having to carry cash and make change for larger purchases, but charge cards may be inefficient for small purchases because of the overhead associated with charge transactions. One of the benefits of the cafeteria is in offering patrons a wide range of food items from light snacks to complete meals with similar convenience and economy regardless of the total cost or extent of the purchases. For example, in a cafeteria a patron can purchase only a cup of coffee as conveniently as an entire three-course meal with side orders. Charge cards are not well-suited to these smaller purchases. For this reason, a conventional charge card is not the optimal basis for an automated payment handler in a cafeteria. It is also inefficient to combine automated charge card payment with automated coin-based vending systems in a cafeteria, because the same food items can be part of a large purchase as well as an individual purchase. For example, if a vending machine were installed to dispense beverages for the convenience of patrons who wished to make only small purchases, then separate facilities would also be needed to serve beverages to patrons purchasing complete meals using charge cards. Otherwise, the patrons purchasing complete meals using charge cards would have to buy their beverages from vending machines, and that would be inconvenient for them.

The free-access vending system disclosed in U.S. Pat. No. 5,728,999 to the present inventor utilizes an automated payment handler that offers equal convenience for both small and large purchases and allows for complete customer self service. This automated payment handler is based on the use of payment cards, one embodiment of which combines a charge function with an electronic purse (a feature of stored value "smart cards") to handle both large and small purchases with the same payment card, and another embodiment of which is a local payment card which is free of transaction overhead (e.g., a payment card issued by an employer to employees for use on company premises, which charges purchases to a prearranged employee account). Likewise, U.S. Pat. No. 4,553,211 to Kawasaki et al., U.S. Pat. No. 4,629,090 to Harris et al., and in U.S. Pat. No. 4,791,411 to Staar disclose hotel room minibar free-access self-service devices wherein customers have prearranged payment accounts. These payment methods solve the problem of making large and small payments equally convenient.

Unfortunately, current systems are limited in their application to traditional stand-alone vending machines and hotel room minibars. There is currently no free-access system that provides for the special requirements of cafeterias, which demand constant real-time replenishment of food items. Moreover, current systems take into account only means of financial accounting for customer purchases of merchandise and therefore do not collect, process, or make available real-time inventory flow and status information that would be of great value in the efficient operation of an automated cafeteria.

In particular, there are the following deficiencies and limitations of cafeterias in general:

It is difficult to monitor and manage the freshness of food items in the cafeteria self-service unit. Each type of food item generally has a limited shelf life in a cafeteria, after which time it must be replaced. This aspect, herein denoted as "freshness control", is normally a difficult process to undertake in a prior art cafeteria.

Another management issue is that of replenishment of food items taken by the patrons. This is commonly performed by visual inspection of the cafeteria self-service unit by a staff person, but in addition to the labor required, visual inspection is inefficient, time-consuming, and often unreliable. This aspect is herein denoted as "replenishment management".

A third management issue is that of assigning space in a cafeteria self-service unit to specific food items. Depending on available supplies of food items and patron demand, there may be a number of different ways of assigning the space of a cafeteria self-service unit. Typically, in a prior art cafeteria, space in a cafeteria self-service unit is assigned on a rigid basis, with only a small amount of ad hoc flexibility that does not formally take into account the dynamic changes in supply and demand that can be expected to occur. This aspect is herein denoted as "shelf management".

There is thus a widely recognized need for, and it would be highly advantageous to have, an automated cafeteria free of the above deficiencies and limitations, having an automated payment handler that adapts the benefits of a free-access vending system to the special requirements of the cafeteria food supply operation and service format, and also having data processing capabilities for automated replenishment management, shelf management, and freshness control. This goal is met by the present invention.

SUMMARY OF THE INVENTION

The present invention successfully addresses the shortcomings of the presently known configurations by providing an automated cafeteria having free-access cafeteria self-service units with item sensing devices and an automated payment handler integrated with a data processing system, wherein food items can be conveniently and efficiently replenished in real time from a kitchen via an access separate from the access point used by patrons to take the food items, and wherein patrons are charged via their payment cards for whatever food items they take. The present invention passes the data from the item sensing devices onto the data processing system to assist in shelf management, replenishment management, and freshness control with minimal labor burden.

By making use of the present invention, the quality and variety of the fare served at an automated cafeteria can be greatly improved and the profitability increased, while significantly reducing the requirements for staff personnel. It is possible, in certain cases, to reduce the required staff to a single person. In addition, the use of data collected from the free-access vending system provides several additional unexpected benefits for improving the efficiency of operating a cafeteria. Even in the minimal cafeteria configurations, the system according to the present invention would be useful in improving food item quality and operational efficiency, while reducing costs. Such minimal configurations of the system according to the present invention will become more and more practical as suitable payment card systems become more commonplace among the public.

Advantages of the Present Invention

Advantages of the present invention over the prior art include the following non-obvious benefits, which result from the incorporation of a free-access vending system, but go beyond the implementation of just an automated payment handler:

1. The layout of the cafeteria self-service unit is far more flexible than in the prior art configurations. This permits more attractive cafeteria self-service units, which may be designed so that they do not look like "vending machines", thereby enhancing the all-important aspect of the way the food is presented to the patron. For example, the cafeteria self-service units can be designed to look like food display cases in a bakery or delicatessen. In such an embodiment, the patrons could be allowed to see over the cafeteria self-service unit into the kitchen area, giving a feeling of openness to the cafeteria. In addition, this lets patrons feel that they are being served by real people, rather than by machines, thereby providing a more conducive environment for dining, generating higher patron satisfaction, and allowing a more generous pricing range.

2. The system according to the present invention provides up-to-the second information for kitchen and planning use, and can extract precise patron purchasing profiles for planning analysis. In addition, the system according to the present invention can collect and process information which is not currently available from prior art point-of-sale terminals, such as latency information on food items. Information of this sort is presently unavailable to cafeteria operators.

3. Pricing of food items can be more versatile. For example, the price of one or more side orders can be included in the price of an entre, and the system can automatically allow the patron to take such items without extra cost. As another example, the system can offer special or combination pricing on a variety of food items. This is another capability which is not provided by prior art automated cafeterias.

Therefore, according to the present invention there is provided a cafeteria self-service system for displaying and selling a plurality of food items supplied from a kitchen to a plurality of patrons, each patron having a payment card; the cafeteria self-service system including: (a) at least one cafeteria self-service unit for the storage and display of the food items, the at least one cafeteria self-service unit being accessible via a first direction from the kitchen and being accessible via a second direction by the patrons, the cafeteria self-service unit including: physical access control means for selectively barring or allowing physical access by the patrons to the food items in the cafeteria self-service unit via the second direction; at least one item sensing device for determining food items placed in the cafeteria self-service unit via the first direction and for determining food items removed from the cafeteria self-service unit via the second direction; a payment card accepting device for accepting payment cards presented by patrons; (b) an access controller for determining when to allow access and when to bar access, and for activating the physical access control means; (c) an automated payment handler for activating the payment card accepting device, validating the payment card, and charging the payment card a selectable amount; (d) a data storage facility storing therein: a pricing schedule for the food items; and food item replenishment criteria to determine a required amount of food items to be supplied to the cafeteria self-service unit via the first direction; (e) a kitchen interface for directing food item preparation operations; (f) a central information and control system interfacing with the access controller, the automated payment handler, the item sensing device, the data storage facility and the kitchen interface; for: receiving notification from the automated payment handler that a valid payment card has been presented; activating the access controller to allow patron access to the at least one cafeteria self-service unit via the second direction; receiving from the item sensing device the identity of each food item removed from the cafeteria self-service unit via the second direction; calculating the required amount of food items to be supplied to the cafeteria self-service unit via the first direction in accordance with the food item replenishment criteria, and activating the kitchen interface to exhibit the required amount; and selectively activating the automated payment handler to charge the valid payment card.

BRIEF DESCRIPTION OF THE DRAWINGS

The invention is herein described, by way of example only, with reference to the accompanying drawings, wherein:

FIG. 10 illustrates an example of a management report which summarizes food item preparation and sales.

DESCRIPTION OF THE PREFERRED EMBODIMENTS

The principles and operation of an automated cafeteria according to the present invention may be understood with reference to the drawings and the accompanying description.

Basic Automated Cafeteria

Figure 1:
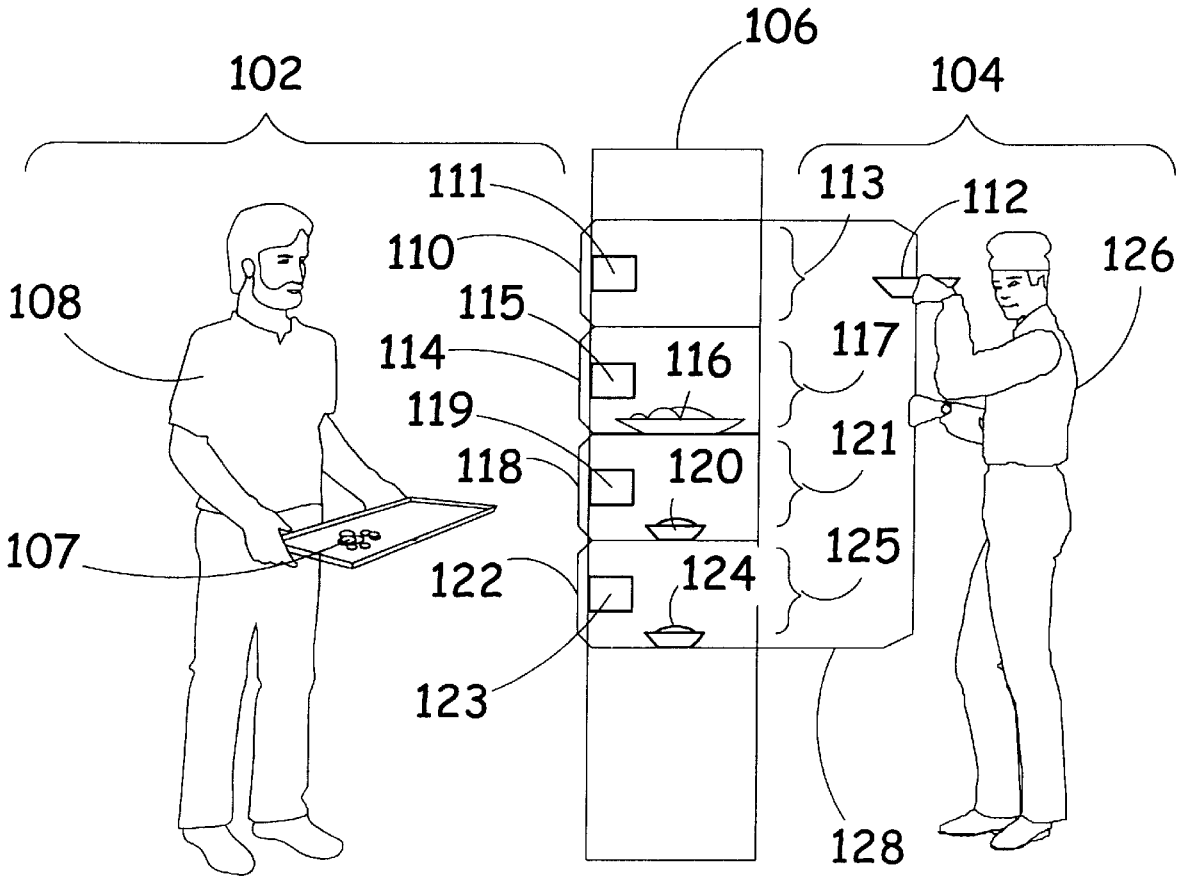
FIG. 1. (PRIOR ART)
FIG. 1 illustrates a cafeteria self-service unit of a prior art automated cafeteria.
Figure 2:
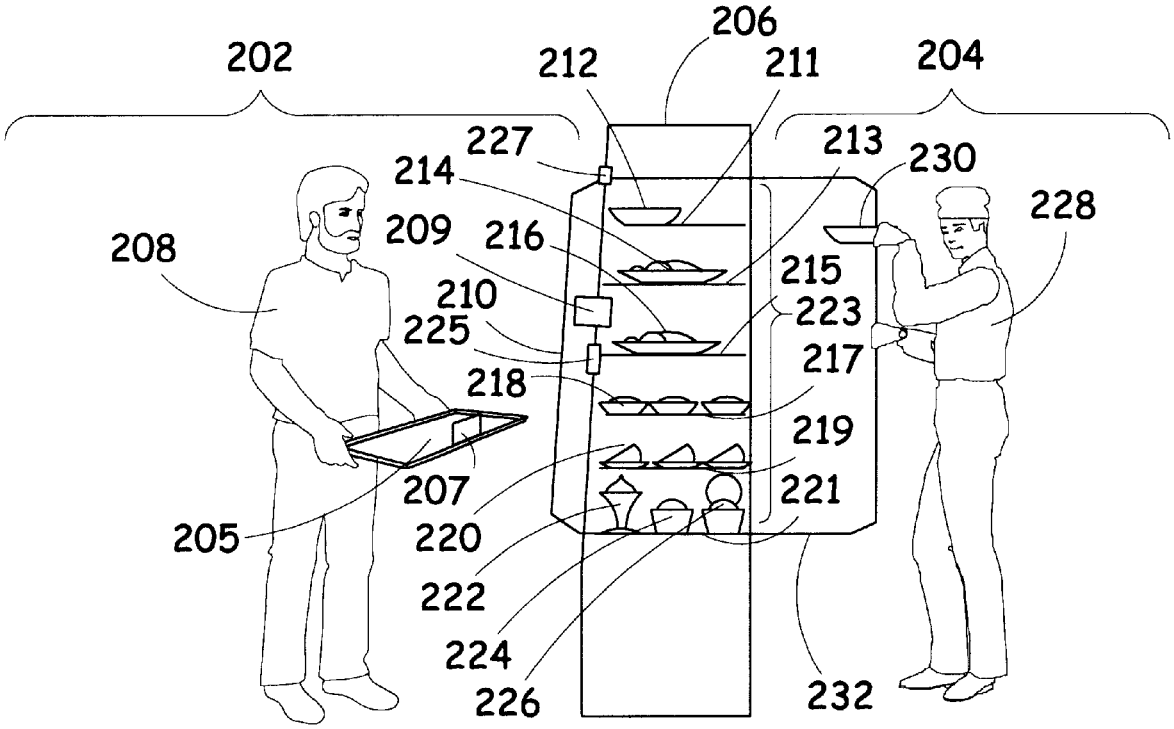
FIG. 2 illustrates a cafeteria self-service unit of an automated cafeteria according to the present invention.

The basic new features according to the present invention are illustrated in FIG. 2, to which reference is now made. As in the prior art automated cafeteria, there are two general areas, a dining and patron self-service area 202 and a kitchen 204, separated by a cafeteria self-service unit 206. As will be discussed in more detail below, a cafeteria self-service unit compartment according to the present invention can be occupied by multiple food items, and different types of differently-priced food items can be placed within a single compartment. It is convenient, then, to conceive of a compartment as an arbitrary subregion of any region of the cafeteria self-service unit which is accessed by a single patron access door. A region which is accessed by a single patron access door can be arbitrarily divided into as a single compartment or multiple compartments. FIG. 2 illustrates an area of cafeteria self-service unit 206 that is accessed, in a non-limiting example, by a patron access door 210. Patron access door 210 provides physical access control, whereby patrons may be selectively allowed or barred from taking food items from cafeteria self-service unit 206. A discussion of access control along with further non-limiting examples thereof is presented below.

The area accessed by patron access door 210 can be thought of as a single compartment 223 which includes a number of shelves: a shelf 211, a shelf 213, a shelf 215, a shelf 217, a shelf 219, and a shelf 221. The advantage to this designation is that a region of the cafeteria self-service unit can be subdivided into compartments based on functional or operational differences. For example, a region of the cafeteria self-service unit accessed by a single patron access door may have one subregion for hot food items and another subregion for cold or frozen food items. These subregions can be considered as separate compartments for operational purposes. Any given shelf will be in a specific compartment, and any given compartment includes at least one shelf. The minimal storage element of a cafeteria self-service unit is herein considered as a compartment, and a cafeteria self-service unit includes at least one compartment. Consequently, a cafeteria self-service unit includes at least one shelf.

In this example, a patron 208 selects from among food items 212, 214, 216, 218, 220, 222, 224, and 226 contained on shelves 211, 213, 215, 217, 219, and 221 displayed behind a common patron access door 210. As with the prior art configuration, removed items are conveniently replenished from kitchen 204 by a staff person 228, who in this example opens an optional service access door 232 to place a food item 230 on shelf 211 of cafeteria self-service unit 206. However, unlike the prior art configuration, the system according to the present invention does not require that food item 230 be placed into an empty compartment or onto an empty shelf. In this example, staff person 228 places food item 230 onto shelf 211, which already contains food item 212. More than a single food item can be placed into a given compartment or onto a given shelf because the free-access vending system is able to charge the patron for whatever food items are taken. In fact, as is discussed below, the food items within a given compartment or upon a given shelf do not even have to be identical nor have identical pricing.

To purchase food items, patron 208 uses a payment card 207. When patron 208 wishes to take one or more selected food items, he presents payment card 207 to a payment card accepting device 209, which is triggered thereby to unlock patron access door 210 by releasing an automatic locking device 225. Patron access door is normally kept locked by automatic locking device 225 to bar access to the food items. At this point patron 208 can open patron access door 210 and freely take whatever items he has selected from the cafeteria self-service unit. After taking the selected food items, patron 208 closes patron access door 210 and removes payment card 207 from being presented to payment card accepting device 209. A door sensing device 227 detects whether patron access door is open or closed. Patron access door 210, in conjunction with automatic locking device 225 and door sensing device 227, functions as an access controller to selectively bar or permit access by the patrons to the food items in the cafeteria self-service unit.

As noted previously, there are no specific restrictions on what can be contained on a given shelf. For example, shelf 221 contains different food item types 222, 224, and 226. The free-access vending system permits different food item types, possibly with different pricing, to be placed anywhere within the cafeteria self-service unit, since the free-access vending system detects which food items the patron takes and bills the patron for the food items taken, regardless of where, and in what compartments, they were originally located. Furthermore, the amount of the billing depends only on the assigned price of the food item, not on the original location (compartment or shelf) of the food item. Note that the illustration in FIG. 2 is intended to show the concept of the arrangement of food items in the cafeteria self-service unit, rather than the specific layout of the food items in the cafeteria self-service unit. For example, different food items might be arranged side-by-side within a shelf, rather than front-to-back as suggested by the arrangement of different food items on shelf 221 (FIG. 2).

Payment Cards

The term "payment card" herein denotes any of the following:

1. any non-cash financial instrument which can be used to make payment for items sold by a vending system; as well as
2. any machine-readable device which uniquely identifies a patron for billing purposes.

Payment cards as defined above include, but are not limited to, charge cards (including cards with credit and/or debit functions, herein referred to as an "electronic checkbook"), local account cards, "smart cards" containing "stored value" in an "electronic purse" (both of the contact-type and contactless RF type), "combo smart cards" (containing both an electronic checkbook and an electronic purse, as defined in U.S. Pat. No. 5,728,999), radio-frequency identification responders (sometimes known as "smart tags"), and machine-readable labels, certificates, or tickets, such as bar-coded identification tags or badges, magnetic-stripe cards, or punched cards.

In the case of a payment card which is a financial instrument, payment for food items is made to the vending system directly via the payment card at the time of purchase. In the case of a payment card which merely serves to identify the patron, a payment account is pre-arranged with the management of the cafeteria for that particular patron, and the payment account is debited according to the prices of the food items taken by the patron.

It is noted that patrons do not necessarily need to have their own personal or individual payment cards. If the business preferences and sales policies of the automated cafeteria's management so permit, patrons may be given temporary payment cards to use for purchasing food items. Such payment cards would not actually make payment for the food items purchased by the patrons, but would accumulate totals for the current meal. The patrons would be billed at the end of the meal according to the charges accumulated by the temporary payment cards. Such temporary payment cards could take special forms. For example, a smart tag (such as a radio-frequency identification responder) can be attached to the tray itself, and might incorporate a simple display for showing the patron the current cost of the accumulated food items.

Reference is made once again to FIG. 2. Precisely how patron 208 presents payment card 207 to payment card accepting device 209 depends on the specific characteristics of the particular payment card used. For example, if payment card 207 is a smart card, then payment card accepting device 209 is a smart card reader, and patron 208 presents payment card 207 by inserting payment card 207 into payment card accepting device 209 (for smart cards with contacts) or by bringing payment card 207 close to payment card accepting device 209 (for radio-frequency smart cards). As another example, if payment card 207 is a bar-coded identification card, then payment card accepting device 209 is a scanner which reads the bar code, and patron 208 presents payment card 207 by causing or allowing payment card 207 to be scanned. As a further example, if payment card 207 is a radio-frequency identification responder, then payment card accepting device 209 is a radio transceiver that establishes contact with payment card 207 when payment card 207 comes into proximity, and patron 208 presents payment card 207 by causing payment card 207 to become near payment card accepting device 209. Any combination of different payment card types may also be utilized, because these are not mutually exclusive.

Data Collection, Processing, and Display

The free-access vending system as disclosed in U.S. Pat. No. 5,728,999 to the present inventor includes an item sensing device for automatically determining precisely which items of merchandise have been removed by the customer. This may be implemented by associating the respective locations of the item sensing devices with the items of merchandise placed in those respective locations, as disclosed in U.S. Pat. No. 5,728,999, and as also described elsewhere herein. It may also be implemented to directly determine the items of merchandise which have been removed by the customer, regardless of the locations of the items of merchandise, such as by the use of commonly-available bar code readers to scan and detect bar codes on the individual items of merchandise removed by the customer. It is the item sensing devices which notify the cafeteria self-service system that food items have been taken, and which identify the taken food items. Using such item sensing devices in a cafeteria self-service system according to the present invention, it is additionally possible to automatically or semi-automatically determine precisely which food items have been added by a staff person, and it is also possible to automatically or semi-automatically determine precisely where these food items have been placed within the cafeteria self-service unit, and how long they have been there. Furthermore, it is also possible to automatically determine, for each patron, precisely which food items have been taken for the present meal, and what the patron's charges are.

Figure 3:
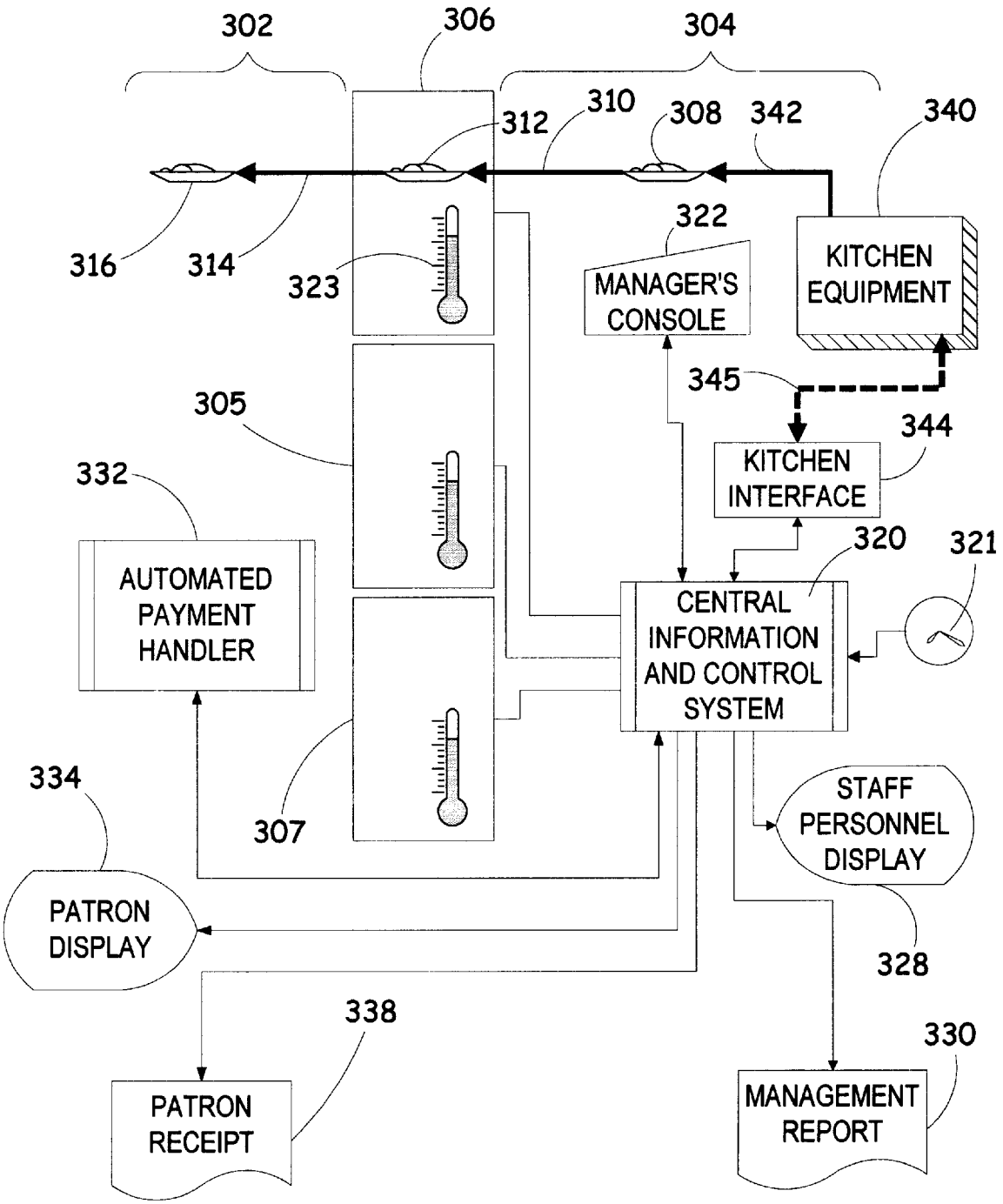
FIG. 3 illustrates conceptually the information flow for patron, management, and automation use in an automated cafeteria according to the present invention.
Figure 12:
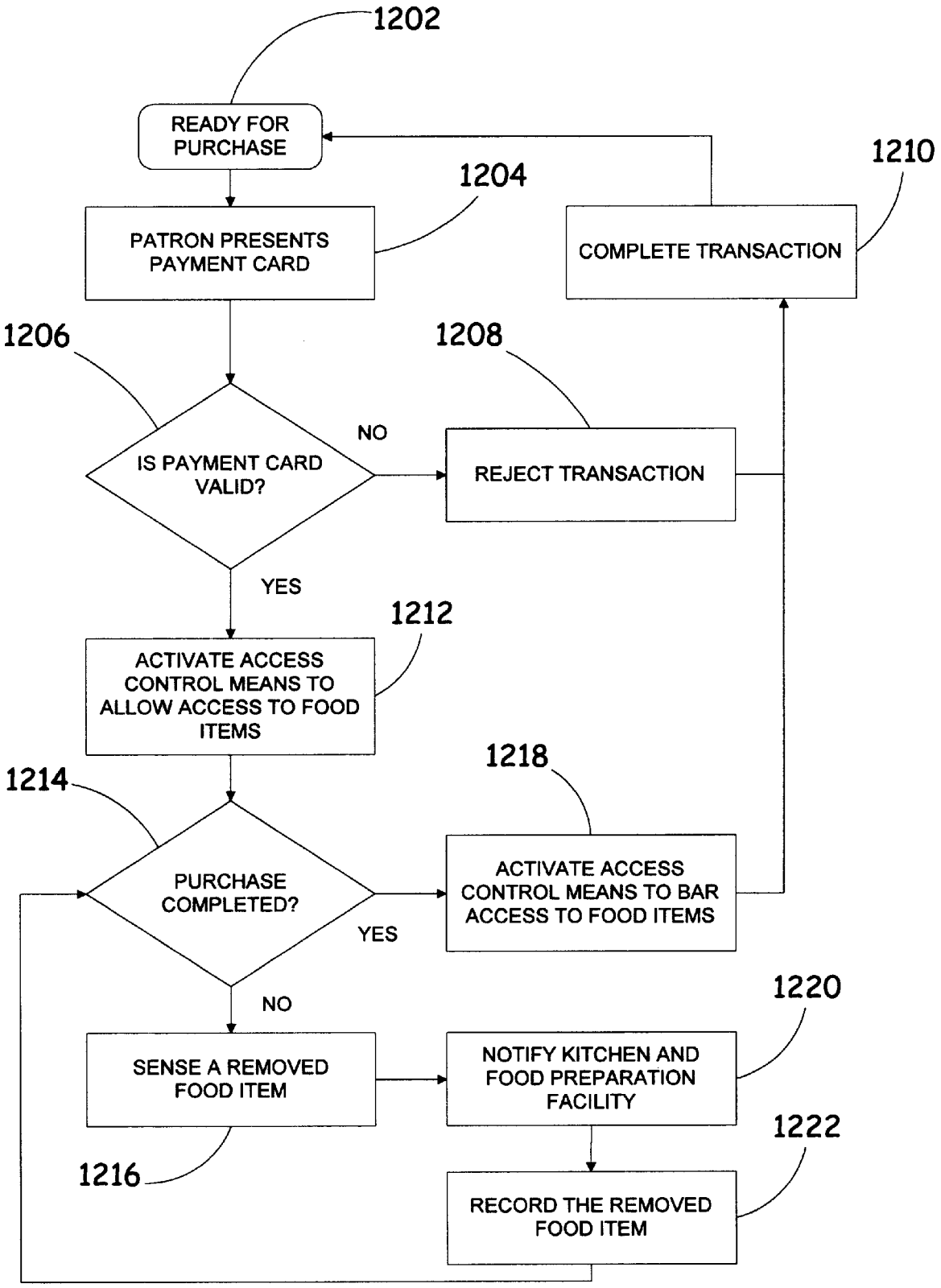
FIG. 12 is a flowchart showing the purchase cycle according to the present invention.

The conceptual flow of information is illustrated in FIG. 3. The logical and physical flow of information depends on the specific configuration and embodiment, and can be implemented by means well-known in the art. The main areas of the automated cafeteria are a dining and patron self-service area 302, a kitchen 304, and one or more cafeteria self-service units, which are here illustrated as cafeteria self-service units 305, 306, and 307. An item of kitchen equipment 340 is used to make ready a prepared food item 308 in a food item preparation operation 342. Thereafter, prepared food item 308 is placed in cafeteria self-service unit 306 by a replenishment operation 310. At this point, there is an available food item 312 in cafeteria self-service unit 306. An automated payment handler 332 validates the patron's payment card and performs financial transactions related to the purchase cycle as described elsewhere herein and illustrated (FIG. 12). When available food item 312 is taken by a patron in a selection operation 314, there is a taken food item 316. Each point in the progression from food item preparation operation 342 to replenishment operation 310 to selection operation 314 is monitored. For example, the replenishment operation 310 and selection operation 314 can be monitored by a sensing means as disclosed in U.S. Pat. No. 5,728,999, and food item preparation operation 342 is monitored and directed by a kitchen interface 344, which directs food supply operations. Kitchen interface 344 may be integral to kitchen equipment 340 or may be manually operated by a staff person. Data readings resulting therefrom are transmitted to a central information and control system 320 which integrates, synchironizes, and coordinates all automatic operation of the cafeteria self-service system and all information processing and reporting. As noted below, kitchen interface 344 connects to kitchen equipment 340 via a link 345, and can be automatic or manual. Other data collected and fed to central information and control system 320 includes temperature information from one or more temperature sensors 323 and date/time information from a clock/calendar 321. There is furthermore a manager's console 322 (which can be implemented with a standard keyboard, pointing device, and monitor) for manual input of commands and selection of operating modes of the system. Live information for patrons is available via a patron display 334, which displays details about individual food items (descriptions, ingredients, nutritional information, pricing, etc.) as well as summaries of the food items taken and the total of their billing for the current meal. A way of implementing patron display 334 is with a standard or large-screen computer monitor, or similar device. It is also noted that patron display 334 can also be implemented as an audio device or combination audio-visual device. An audio capability can be implemented by means well-known in the art to include automatic verbal and/or musical announcements from live, pre-recorded, or computer-synthesized material. A patron can obtain a printed itemized receipt 338 for the meal. Likewise, live information for staff personnel is available on a staff personnel display 328, as are printed management reports 330. A way of implementing staff personnel display 328 is likewise with a standard or large-screen computer monitor. As with patron display 334, staff personnel display 328 can also be implemented as an audio device or combination audio-visual device.

In order to communicate with central information and control system 320, kitchen equipment 340 requires kitchen interface 344 to allow central information and control system 320 to control food supply operation and to receive status information and other data from kitchen equipment 340. Kitchen interface 344 can be built into kitchen equipment 340 and operate automatically, in which case link 345 is integral to kitchen equipment 340. Alternatively, kitchen interface 344 can be a manually-operated adjunct to kitchen equipment 340, such as a keypad with a display, in which case link 345 is performed by a staff person. Kitchen interface 340 can also include or control staff personnel display 328.

As noted above, FIG. 3 represents a conceptual arrangement of the described components, but there are many possible logical and physical configurations of the components which perform the identical function. For example, automated payment handler 332 could, but need not physically contain payment card accepting device 209 (FIG. 2). The payment card accepting device can be alternately and just as easily considered a physical part of cafeteria self-service unit 306, wherein the payment card accepting device communicates with automated payment handler 332 via central information and control system 320. This configuration is advantageous where there are many cafeteria self-service units. Each cafeteria self-service unit could have a separate payment card accepting device, but only a single automated payment handler would be needed, because all the payment card accepting devices would be linked to the single automated payment handler via the central information and control system. The automated payment handler, however, is considered to functionally contain some means for accepting the payment card from the patron, whether through incorporation of a physical payment card accepting device or through communication with a physical payment card accepting device. The conceptual arrangement shown in FIG. 3, wherein there is a single central information and control system as opposed to separate control systems for each cafeteria self-service unit is advantageous and not only results in reduced equipment costs, but also provides an inherently more consistent information base to operate the automated cafeteria. Accordingly, embodiments of the present invention include means for:

1. tracking the food items in the cafeteria self-service unit;
2. displaying the status (e.g., age) of food items in the cafeteria self-service unit for staff personnel;
3. displaying the descriptions and pricing of food items in the cafeteria self-service unit for patrons;
4. displaying and printing receipts for patrons showing the food items they have taken and the total charges for their meals;
5. recording the buying of the various food items by patrons as a function of time, for off-line analysis;
6. performing a real-time analysis of the buying patterns of patrons for the various food items to derive current demand profiles;
7. projecting the current patron demand for various food items based on the real-time analysis;
8. performing an off-line analysis of the buying history of patrons for the various food items to derive demand profiles;
9. projecting the patron demand for various food items based on the off-line analysis;
10. allowing the manager of the automated cafeteria to select the mode by which the inventory of food items in the cafeteria self-service unit is maintained;
11. comparing the inventory of food items in the cafeteria self-service unit against the current and projected patron demand, according to the selected mode of inventory maintenance; and
12. alerting staff personnel to inventory shortages or surpluses based on the current and projected patron demand for the various food items, according to the selected mode of inventory maintenance.

Kitchen Equipment

An automated cafeteria according to the present invention defines a kitchen whose function is to provide facilities for replenishing food items into the cafeteria self-service unit. As will be described in further detail below, however, the makeup and operation of the kitchen is not limited and can be based upon many different variations, ranging from a fully-equipped conventional kitchen to an equipment-less staging area for placement of food items into the cafeteria self-service unit. For those cafeterias having a conventional kitchen, the following defines terms relating to kitchen equipment.

Kitchen equipment suitable for use with a system according to the present invention, Such as kitchen equipment 340 (FIG. 3), can be manual kitchen equipment, semi-automatic kitchen equipment, automatic kitchen equipment, integrated kitchen equipment, or any combination thereof as defined below.

The term "manual kitchen equipment" herein denotes any kitchen equipment which is incapable of performing a complete food item preparation step without human assistance or intervention. Manual kitchen equipment includes motorized kitchen equipment which requires human control in performing a complete food item preparation step, such as stopping the motor when the food item preparation step is complete.

The term "semiautomatic kitchen equipment" herein denotes any kitchen equipment which can perform at least one food item preparation step without human intervention. However, semi-automatic kitchen equipment does not necessarily perform all the necessary preparation steps for a particular food item without human intervention. Many types of common kitchen equipment can serve as semi-automatic kitchen equipment. For example, many microwave ovens have a defrost cycle for frozen food items, which applies a moderate amount of power to defrost a food item for a specified time, pausing at regular intervals to allow the rearrangement of the food item in the oven cavity. The timing and cycling of the power is a step done without human intervention, whereas the rearrangement requires human intervention. An example of institutional semi-automatic kitchen equipment is the Hobart "HSRO" oven (manufactured by the Hobart Corporation of Troy, Ohio), which can handle multiple food items at the same time and is programmable.

The term "automatic kitchen equipment" herein denotes any item of kitchen equipment which can perform a complete food item preparation step without human assistance or intervention. Examples of automatic kitchen equipment include automatic coffee-makers and bread-making machines. Once the ingredients are loaded, these appliances are able to perform the preparation of their respective food items without any human assistance or intervention. Some examples of such appliances are furthermore able to time-schedule the preparation using an internal clock. Note that an item of automatic kitchen equipment may still require human assistance or intervention, such as when loading ingredients or unloading the prepared food items; to classify as automatic kitchen equipment, an item of kitchen equipment need only be able to perform at least one food item preparation step by itself.

The term "integrated kitchen equipment" herein denotes any item of kitchen equipment which contains a computer interface. The term "semi-integrated kitchen equipment" herein denotes such kitchen equipment whose interface sends information only from the kitchen equipment to the computer. An example of semi-integrated kitchen equipment is a scale which sends weights to a computer for calculating prices and printing a price tag. The term "fully-integrated kitchen equipment" herein denotes kitchen equipment with a bidirectional interface that sends information both from the kitchen equipment to the computer and also from the computer to the kitchen equipment. An example of fully-integrated kitchen equipment is a refrigerator/freezer which sends temperature information to the computer for monitoring and whose temperature may also be controlled by the computer, such as for a defrosting cycle.

Data Flow and Food Item Identification

An important and unexpected benefit of structuring an automated cafeteria around a free-access vending system is that the free-access vending system provides and implements a central collection point for data regarding the replenishment, purchase, and latency of food items. The term "latency" herein denotes the amount of time a specific food item has been in a cafeteria self-service unit. This data can be processed by a central information and control system and distributed to various points throughout the automated cafeteria. When processed and presented as relevant information, this data can be highly advantageous to patrons and management alike in an automated cafeteria. FIG. 3, as previously discussed, presents a conceptual overview of the data collection and information processing, flow, and presentation according to the present invention.

Figure 4:
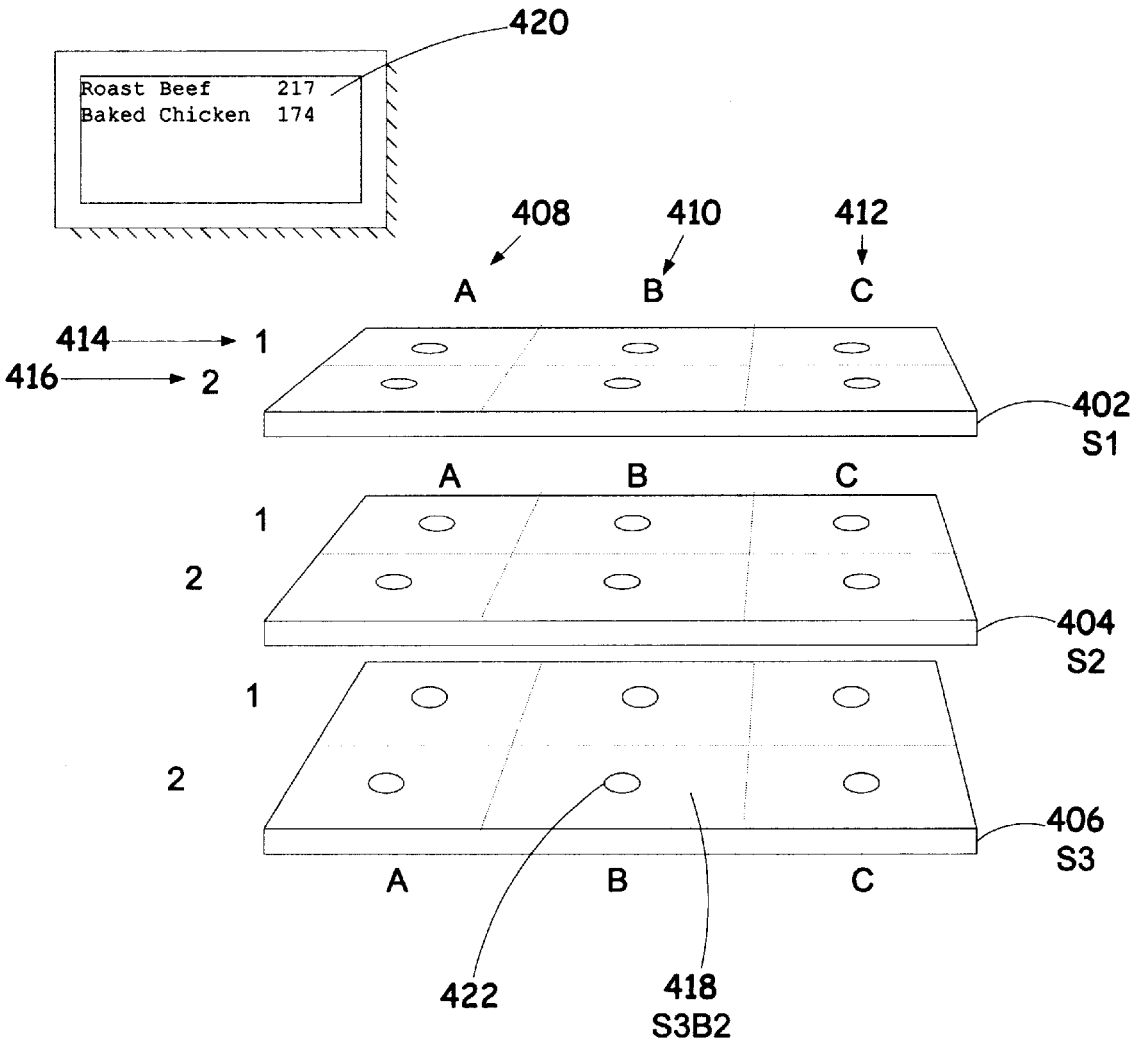
FIG. 4 illustrates a scheme for identifying food item locations in a cafeteria self-service unit.

For reference purposes, it is desirable to be able to unambiguously identify specific food items in the cafeteria self-service unit. In order to do this, a simple location identification scheme may be used, as illustrated in FIG. 4. Shown are a shelf 402, a shelf 404, and a shelf 406. Shelf 402 is designated as S1, shelf 404 is designated as S2, and shelf 406 is designated as S3. Each shelf is divided front-to-back into three sections, designated as A 408, B 410, and C 412, and also divided side-to-side into sections, designated as 1 414 and 2 416. The six divisions on each shelf are thereupon identified by their section designations, in front-to-back, and side-to-side order, and the eighteen divisions are moreover distinguished by their shelf number. For example, a division 418 is located on shelf 406 (S3), front-to-back section 410 (B), and side-to-side section 416 (2). Thus, the complete designation of division 418 is S3B2. A food item located in division 418 can be thus identified as S3B2. Additional shelves in various compartments can be given unique designations. Each shelf must have a unique identifier, but not all shelves need have the same number of divisions.

In a preferred embodiment of the present invention, each division has an item sensing device, a representative example of which is shown as an item sensing device 422, for determining the presence, removal, and replacement of a food item relative to that division. Variations on item sensing devices are disclosed and described in U.S. Pat. No. 5,728,999. Also, in a preferred embodiment of the present invention, there is an interactive staff personnel console device 420, for indicating the specific food item type placed in a division. Staff personnel console device 420 can be, for example, an interactive touch-sensitive display. When a staff person places a food item in a particular division, the item sensing device of that division will signal a central information and control system (described elsewhere herein), which in turn will display on staff personnel console device 420 the food item type currently assigned to that division. If the food item which has just been placed in the division is of a different type, the staff person will indicate the food item type of the replaced food item via staff personnel console device 420 (such as by touch, for an interactive touch-sensitive display), whereupon the central information and control system will update the data tables associating that specific division with the proper food item type.

Optional Separate Beverage Maintenance and Replenishment Management

Figure 5:
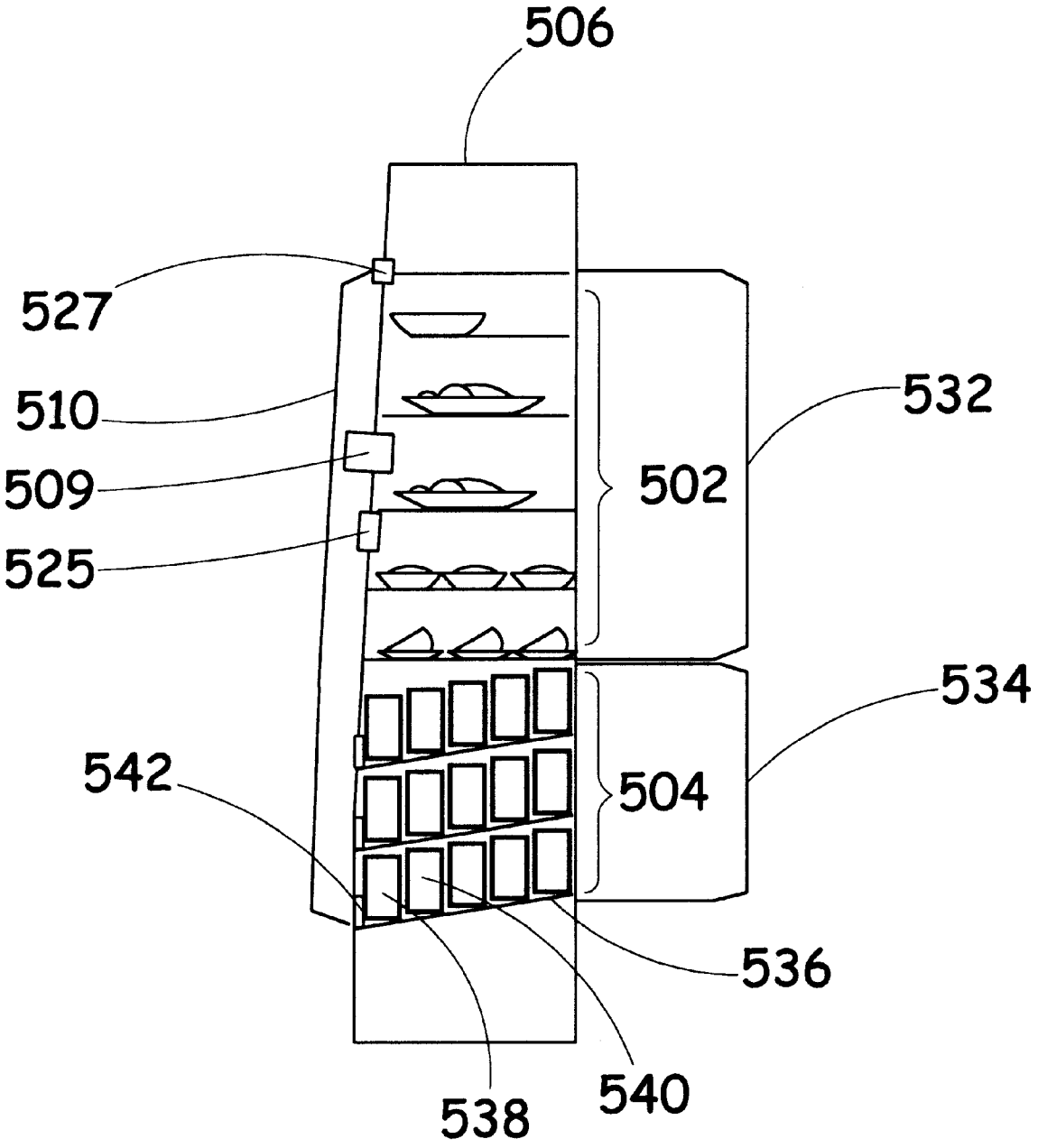
FIG. 5 illustrates an embodiment of a cafeteria self-service unit with a separate service access door for beverages.

As previously noted, beverages such as canned or bottled soft drinks can be loaded into the cafeteria self-service unit and maintained by an outside firm under contract, in order to relieve staff personnel of the need to do this. It may be more efficient and cost-effective to out-source the maintenance and restocking of an adequate beverage supply. Therefore, according to the present invention there is provided an optional feature of the cafeteria self-service unit to facilitate this. FIG. 5 illustrates a cafeteria self-service unit 506 with a single patron access door 510 and a single payment card accepting device 509, and having two compartments, a compartment 502 for prepared food items and a compartment 504 for beverages, which in this case are canned beverages. As with the cafeteria self-service unit shown in FIG. 2, there is an automatic locking device 525 for barring access to the food items, and a sensing device 527 for determining whether patron access door 510 is open or closed. Compartment 502 has a service access door 532 and compartment 504 has a separate service access door 534. Compartment 504 contains one or more shelves, such as a shelf 536 on which are beverages such as a beverage can 538 and a beverage can 540. Canned or bottled beverages may be fed to the front of cafeteria self-service unit 506 by any of various means well-known in the field of conventional vending systems. The term "front" herein denotes the direction of the cafeteria self-service unit accessed by the patrons. For example, as illustrated in FIG. 5, shelf 536 slopes downward toward the front of cafeteria self-service unit 506 so as to permit gravity to feed the beverages to the front. A stop 542 at the front of shelf 536 prevents the beverage cans from sliding out of compartment 504 when patron access door 510 is opened, but when a patron removes a beverage can, such as beverage can 538, by raising it over stop 542, another beverage can, such as beverage can 540, automatically slides forward toward the front for convenient patron access.

Service access door 532 is intended for the replenishment of food items in compartment 502. Service access door 534, however, is intended for the replenishment of beverages in compartment 504. Because there are separate service access doors for the two compartments of cafeteria self-service unit 506, it is possible to have different personnel perform the replenishment. The prepared food items in compartment 502 are clearly to be replenished on an on-going basis from the kitchen, and so staff personnel of the automated cafeteria would use service access door 532 to do this. The beverages in compartment 504, however, may be conveniently replenished by other personnel during off-peak hours by outside personnel, thereby relieving staff personnel of the automated cafeteria of this responsibility. It is also possible to employ a separate patron access door for compartment 504, but this is not necessary, because the automated payment handler can maintain separate accounting for purchased beverages, and would possibly inconvenience the patrons by making them perform an additional step to purchase beverages. Furthermore, it is also possible in some cases to use a service access point to replenish the beverages which is located apart from the kitchen, such as in the front of the cafeteria self-service unit, if the replenishment would occur during non-operating hours, when the replenishment would not interfere with the patrons. In any case, a cafeteria self-service unit which can hold independently-replenished food items would have a number of independent service access points.

Information Processing and Reporting

Figure 6:
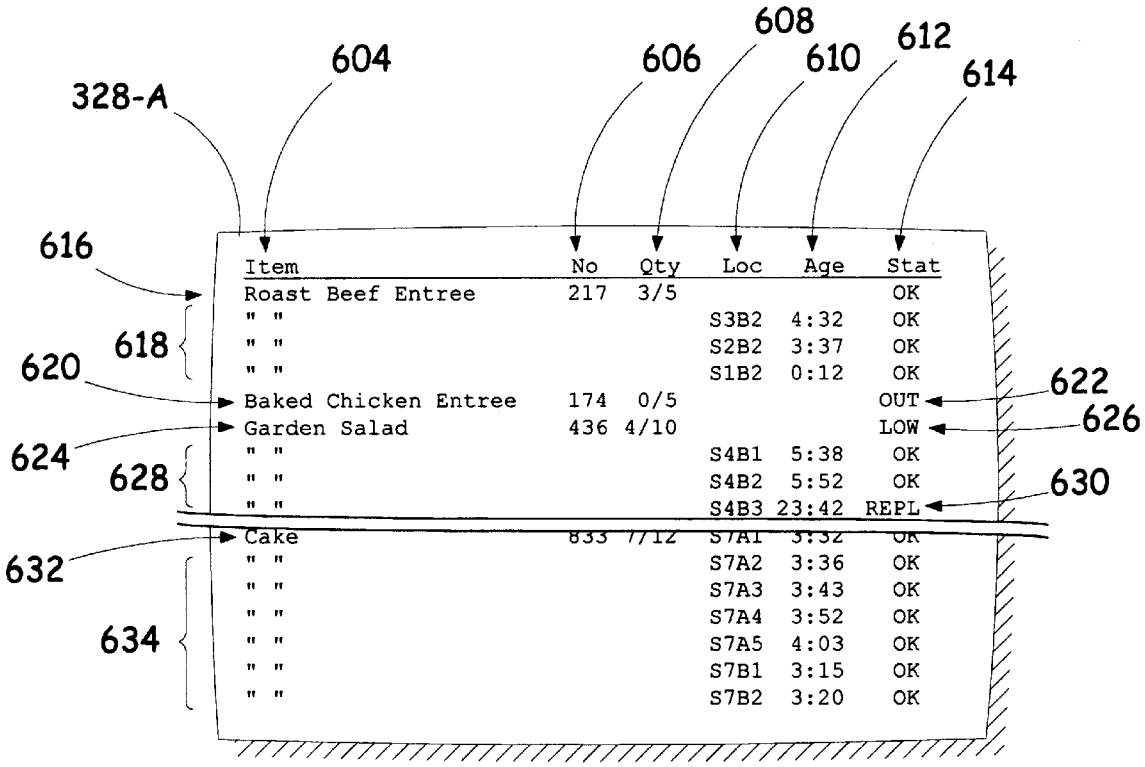
FIG. 6 illustrates an example of a staff personnel display showing the status of food items in a cafeteria self-service unit.

Referring again to FIG. 3, it is seen that data collected at cafeteria self-service unit 306 is passed to management information system 320 and from there onto staff personnel display 328. FIG. 6 illustrates an example of such a staff personnel display 328-A, which maintains status information on the food items currently located in the cafeteria self-service unit. A column 604 of staff personnel display shows a description of each listed food item type. A column 606 shows an intenial identification number of each listed food item type. A column 608 shows the current quantity of each listed food item type separated by a slash ('/') from the desired or programmed quantity of that food item type. A column 610 shows the location of each listed individual food item. A column 612 shows the age in minutes and seconds (the amount of time in the cafeteria self-service unit, also known herein as the 'latency') of each listed individual food item. A column 614 shows a status code for each listed food item type as well as each listed individual food item. A line 616 lists a food item type (a roast beef entre) and a line group 618 lists a set of individual food items of that type. The status shown in column 614 for the food item type listed in line 616 is the status for that entire type of food item in the cafeteria self-service unit, whereas the status shown in column 614 for the individual food items listed in line group 618 is for the individual food items in the cafeteria self-service unit. Similarly, a line 624 lists a food item type (a garden salad), and a line group 628 lists a set of individual food items of that type. A status 626 shown in column 614 for line 624 indicates that the quantity of this food item type is "LOW", with only 4 individual portions out of a desired quantity of 10 present in the cafeteria self-service unit. Moreover, one of the individual portions appears to have been in location S4B3 in the cafeteria self-service unit for over 23 minutes, and thus a status 630 shown in column 614 indicates "REPL", or that a replacement is in order (perhaps this particular food item is defective or otherwise undesirable to patrons). Likewise, a line 632 lists a food item type (cake) whose individual food items are listed in a line group 634. There is illustrated, however, a line 620 which lists a food item type (baked chicken entre) for which there are no individual portions. A status 622 shows that this food item type is "OUT", calling attention to the fact that the quantity listed in column 608 shows there to be no individual portions of this food item type. A staff personnel display such as that shown in FIG. 6 can greatly improve the efficiency of an automated cafeteria by automatically alerting staff personnel to deficiencies or problems of food items in the cafeteria self-service unit. Other types of staff personnel displays can be configured, to show other arrangements of useful information, perhaps in graphical or animated format. For example, a graphical display of the temperatures in cafeteria self-service unit according to temperature sensors 323 (FIG. 3) can alert staff personnel to out-of-range temperatures which could adversely affect the food items in the cafeteria self-service unit. A number of monitors could be employed to simultaneously show these various displays, and the displays can be alternated at prearranged intervals so that a single monitor shows a variety of displays. In this way, the staff personnel burden of having to periodically survey the food items in the cafeteria self-service unit can be greatly reduced.

Figure 7:
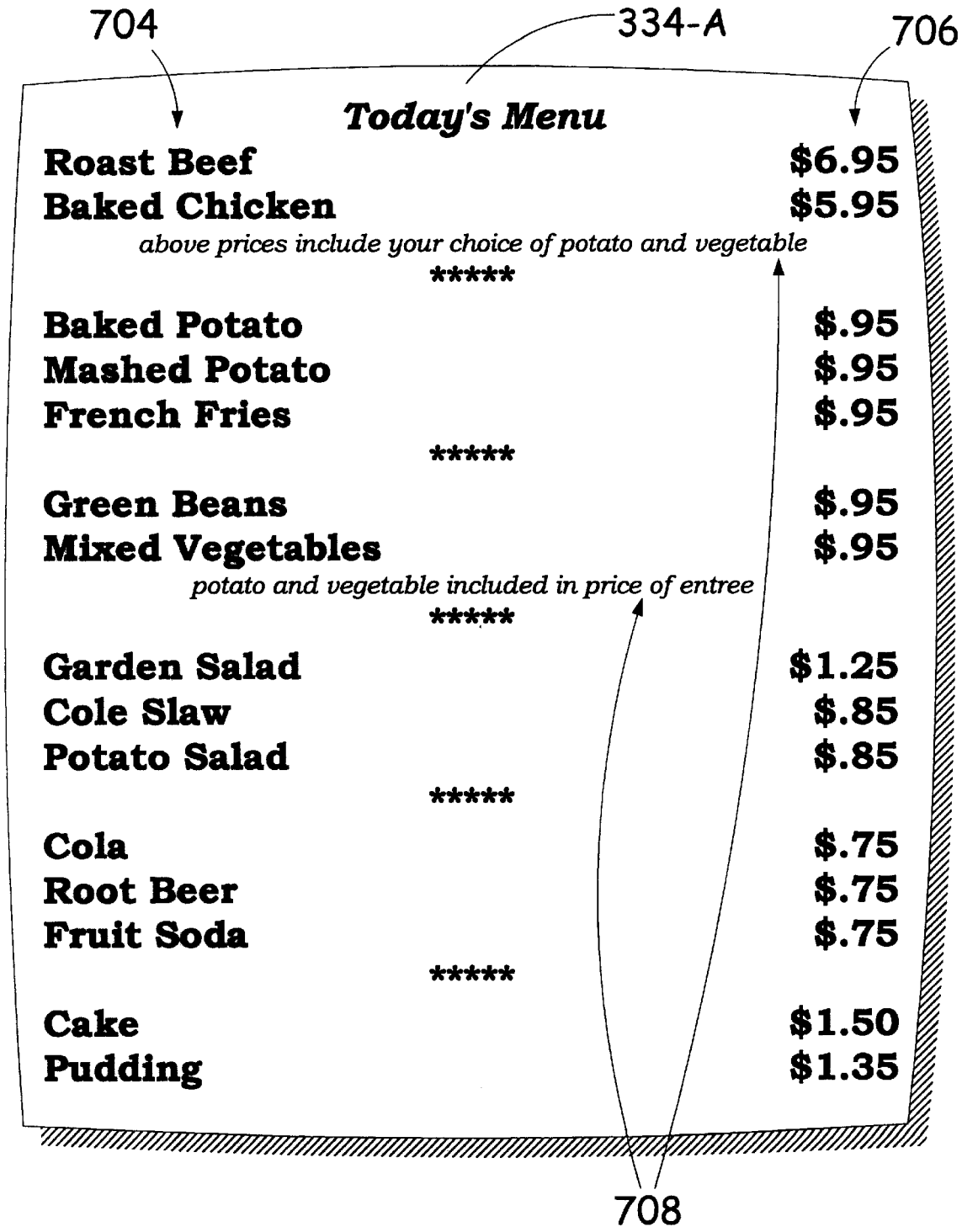
FIG. 7 illustrates an example of a patron display which shows a menu.

Referring once again briefly to FIG. 3, it is seen that there is the possibility of displaying information to benefit patrons via a patron display 334. FIG. 7 illustrates an example of such a patron display 334-A, which shows a menu of the current bill of fare, arranged the same as a conventional printed menu or menu board in a conventional cafeteria, wherein a column 704 lists the various food items, and a column 706 lists their corresponding prices, and qualifiers 708 indicate that certain food items which make up a meal can be purchased for a combined price. Unlike a conventional printed menu or menu board in a conventional cafeteria, however, patron display 334-A can be easily updated electronically by a staff person, such as from manager's console 322 (FIG. 3). If, for example, the automated cafeteria is all out of the baked chicken entre, as indicated in line 620 of staff personnel display 328-A (FIG. 6), and cannot replenish this food item from the kitchen, then this food item can be removed automatically from the menu in patron display 334-A. Likewise, if there are substitutions, additions, price changes, and so forth, in the bill of fare, patron display 334-A can be updated immediately and with virtually no effort on the part of staff personnel. Modem computer graphics and animations can enliven the patron displays to call attention to special offers and featured food items. Moreover, the automated payment handler can be automatically coordinated with the menus in the patron displays to charge patrons the prevailing prices on individual food items or combinations thereof.

Figure 8:
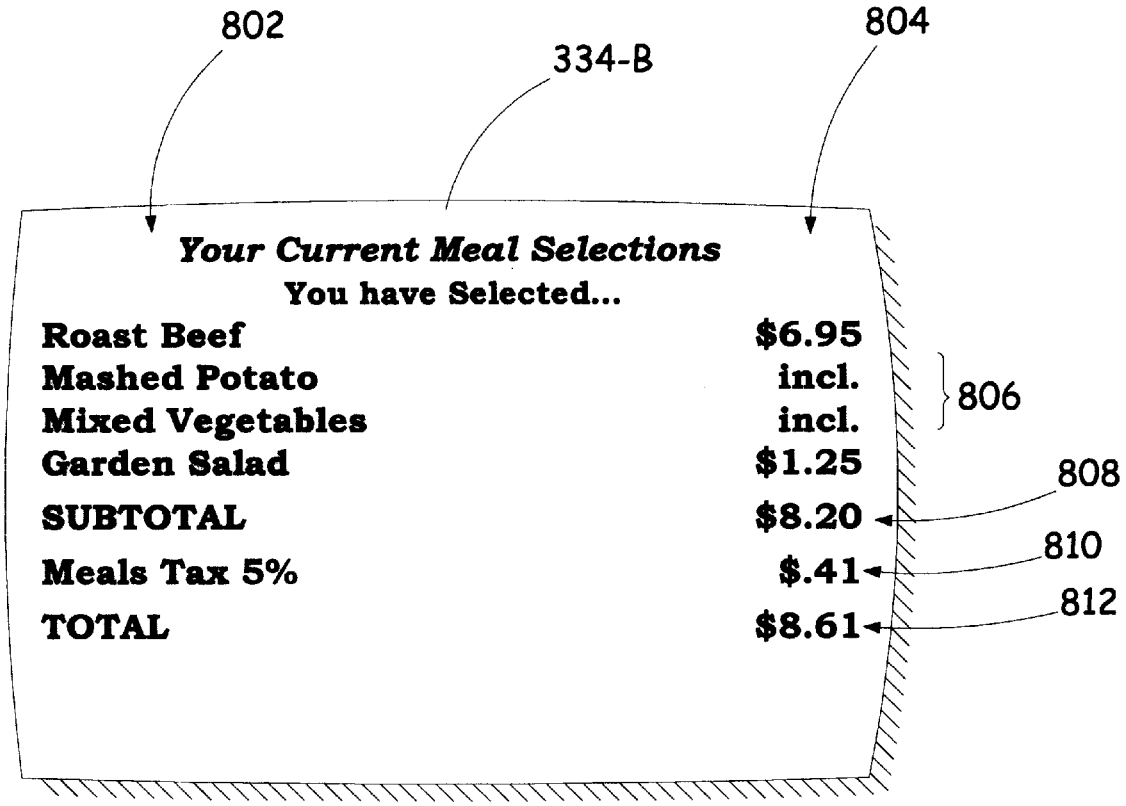
FIG. 8 illustrates an example of a patron display which shows the patron's current selection.

FIG. 8 illustrates another example of a patron display 334-B. Such a patron display could be implemented by a one or more small monitors located within the cafeteria self-service unit, and can be activated upon patron request, or upon presentation of a payment card. In a column 802 patron display 334-B shows the patron what food items he has taken so far during this meal, and in a column 804 the respective prices are listed. As previously noted, the automated payment handler takes into account the displayed combination pricing, so certain food items in a line group 806 are shown as included within the price of the entre. In a line 808 the subtotal for the food items is shown. Incidental other items, such as tax, can be shown, as illustrated in a line 810. Finally, the current total for the meal is displayed in a line 812. By means of such a patron display, a patron can immediately find the total cost of the food items he has taken as he takes them.

Figure 9:
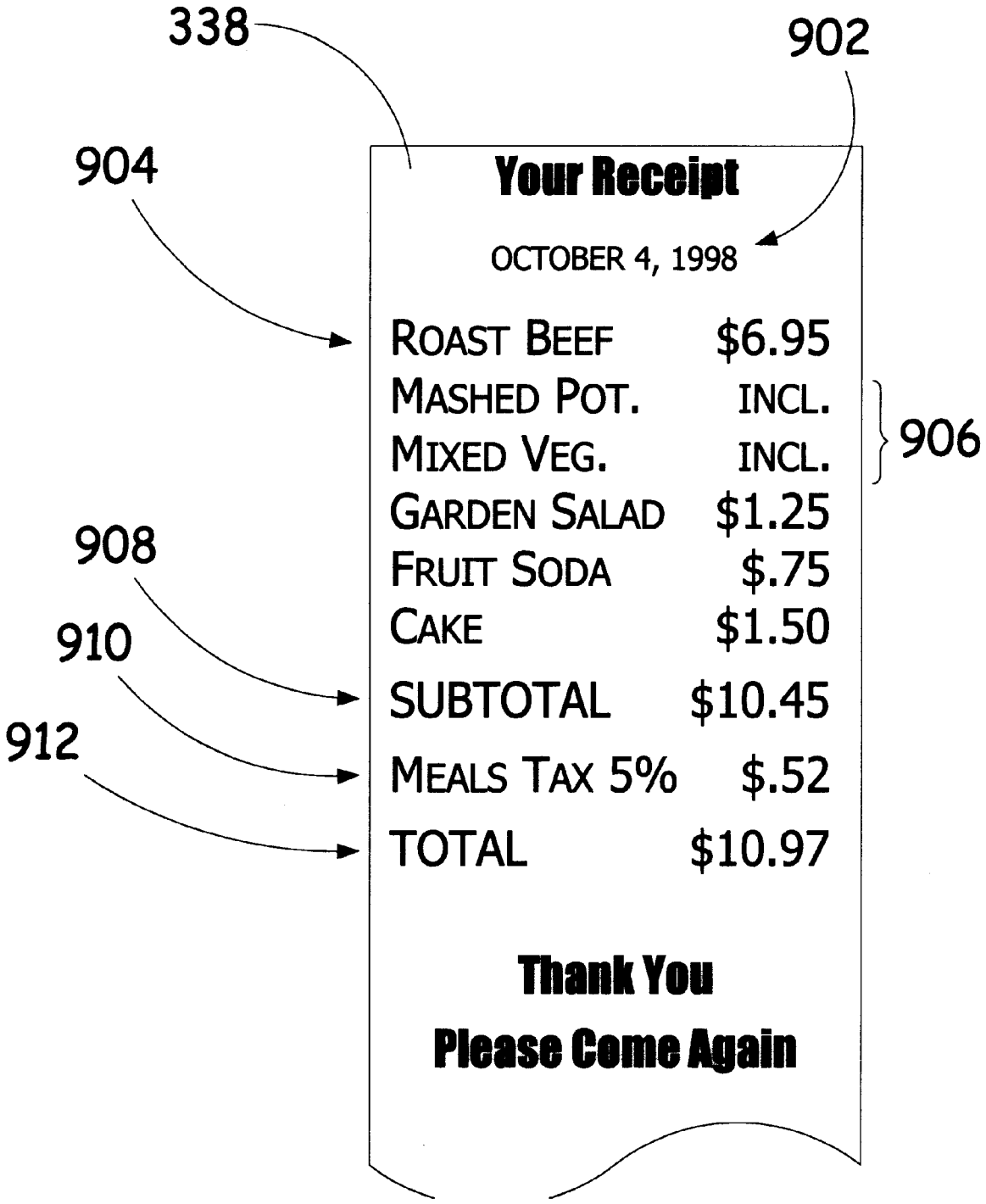
FIG. 9 illustrates an example of a patron receipt automatically issued at the patron's request.

Referring yet again briefly to FIG. 3, it is seen that the automated payment handler is capable of giving the patron printed receipt 338 of the cost of his meal, for expense or other purposes. An example of printed receipt 338 is illustrated in FIG. 9. Printed receipt 338 is dated with a date 902 and is otherwise identical to a conventional printed receipt, except that it is generated automatically by the automated payment handler. Separate food items appear as line items (such as a line item 904), and the automated payment handler includes certain components of the meal in a line group 906 without additional charge, where appropriate. The subtotal of the food items appears in a line 908, and additional items, such as tax appear in a line 910. The total charged to the patron appears in a line 912. The format of printed receipt 338 is similar to that of patron display 334-B (FIG. 8), but printed receipt 388 includes the entire meal, whereas patron display 334-B includes only those food items taken as of the time of the viewing of patron display 334-B. In addition, the patron may view patron display 334-B as often as he desires, but generally will be given only a single copy of printed receipt 388. It is important to remember that the automated payment handler receives payment for each food item at the time the patron takes that food item from the cafeteria self-service unit. Patron display 334-B and printed receipt 338 are solely for the benefit of the patron, to view his accumulated billing. Patron display 334-B and printed receipt 338 merely show what has already been taken and billed, but are not used for actual billing purposes. After giving the patron a printed receipt, the automated payment handler will reset that patron's current billing record. In addition, since a patron need not request nor necessarily be given a printed receipt, the automated payment handler will normally reset each patron's current billing record automatically at regular intervals, such as at the end of each meal period, or at the end of each day.

Figure 11:
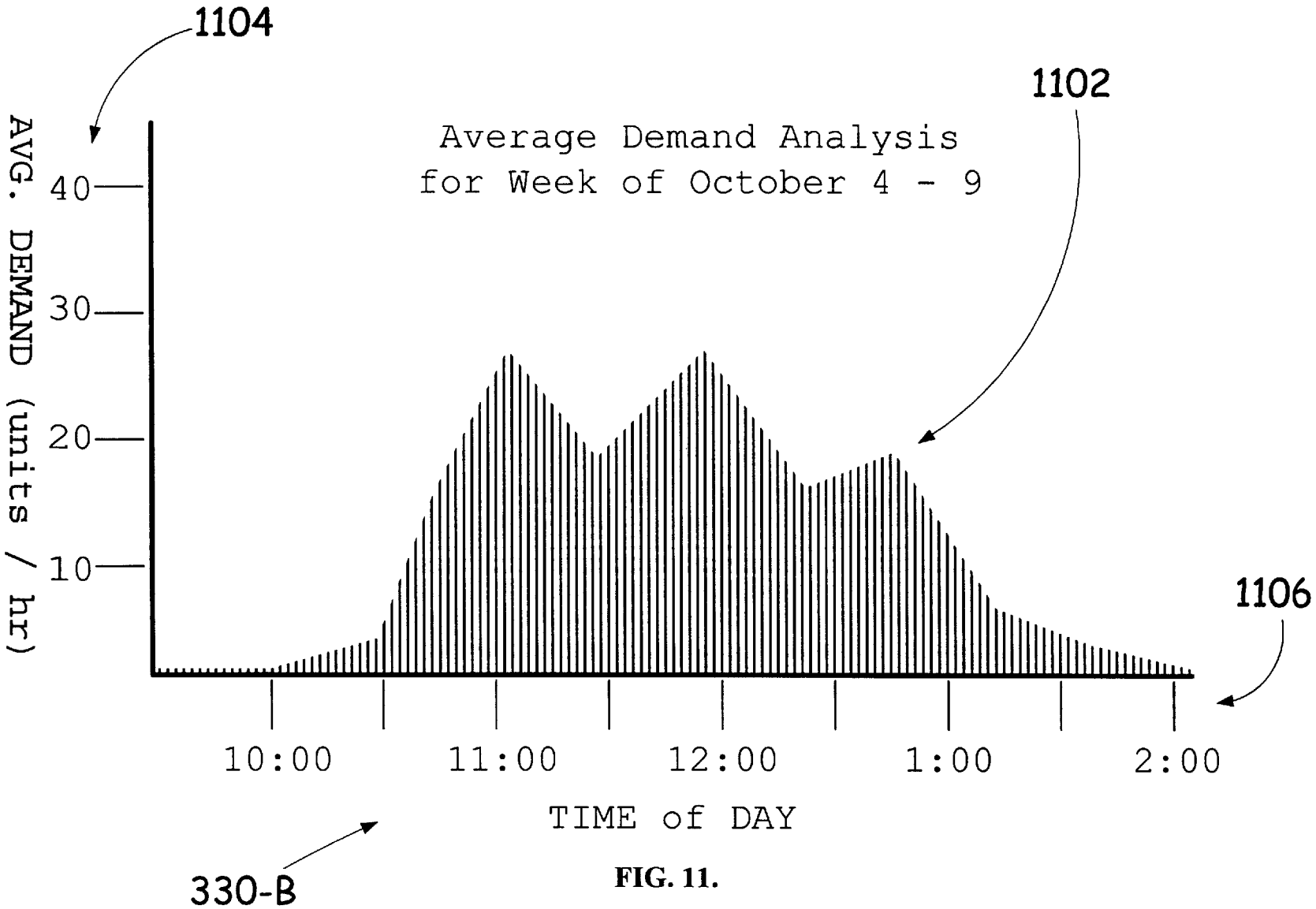
FIG. 11 illustrates an example of a management report which shows average food item demand peaks.

Management reporting is an important benefit of the system according to the present invention. As shown in FIG. 3, Management Information System 320 is able to output management report 330. FIG. 10 shows an example of such a management report, as a weekly management report 330-A listing the cumulative items prepared and sold for a time period. A column 1002 gives the internal identification number of each listed food item. A column 1004 gives a brief verbal description of the food item. A column 1006 gives the number of portions of the food item prepared for sale during the applicable time period, and a column 1008 gives the number of portions of the food item which were sold. Note that the term "prepared for sale" denotes that the food item was placed into the cafeteria self-service unit. A column 1010 gives the price of the item, and a column 1012 gives the average latency (time in the cafeteria self-service unit) of the food item. A line group 1014 lists the food items covered in management report 330-A. The information to be given in the various columns of management report 330-A have been selected arbitrarily as an example only, and other arrangements and information could also easily be presented in similar reports. For example, instead of reporting on the number of portions of food items prepared for sale and the number sold, it is possible to report on the number prepared for sale and the number which were unsold, as well as percentages unsold, etc. FIG. 11 shows an example of a completely different sort of management report 330-B. Management report 330-B presents a graph 1102 of the average demand for food items in units per hour on an ordinate 1104 as a function of time of day during operation of the automated cafeteria on an abscissa 1106. Information from analysis such as this can be very helpful to management in scheduling workflow to handle patron demand. It is noted that information of this sort can also be presented interactively via manager's console 322 (FIG. 3) as well as being printed out on paper.

Computer systems including processing hardware, peripheral devices, operating systems, and software which are currently available are adequate for implementing the central information and control system according to the present invention. In particular, commercially-available computer monitors, keyboards, printers, media drives, modems, pointing devices, and other such devices can be used for both manual and automated data input, and for automated output and display of information. For example, the patron display and the staff personnel can be implemented with a standard monitor. The management reports and printed receipts can be implemented with commercially-available printers. The use of a modem allows an automated cafeteria according to the present invention to efficiently communicate order requests to a central supply facility and report business activity. The use of a media drive, such as a CD-ROM drive or a floppy disk drive, enables an automated cafeteria according to the present invention to have access to preplanned menus, pricing schedules, and so forth, as well as to maintain detailed accounting information for future use. In addition, the free-access vending system as disclosed in U.S. Pat. No. 5,728,999 to the present inventor includes a remote account interface which is suitable for interfacing the free-access vending system (including the item sensing devices thereof) employed in the present invention to the central information and control system described herein.

It is further noted that the nature of the data collection in a system according to the present invention is inherently more accurate, more comprehensive, and more cost-effective than is possible in prior art systems. First, the data collection is performed in a central location automatically by the automated payment handler through the employment of the item sensing devices of the free-access vending system, and this central location is the cafeteria self-service unit, which is the physical interface between the preparation of the food items by the staff personnel and the consumption of those food items by the patrons. Prior art data collection systems would be restricted to either the kitchen or to the cashier stations. In either case, there is missing data. If data is collected at the kitchen, then it reflects only the food items prepared for sale, but does not reflect actual sales. Furthermore, data collection at the kitchen cannot be fully automated unless the kitchen equipment is fully automated. If data is collected at the cashier stations, then it reflects only the food items actually sold, and it further requires human participation in the collection of payment or charging of accounts. Even if data is collected both at the kitchen and at the cashier stations, there is missing data because the correlation between the prepared for sale of a particular food item and the sale of that particular food item is not available. This is the latency information—how much time elapses from the prepared for sale of a particular food item and the purchase of that same particular food item.

Thus, the automated payment handler of the free-access vending system of the present invention not only reduces labor by eliminating the need for a human cashier, but also yields the unexpected and non-obvious benefits of automatically providing valuable information to improve the efficiency of cafeteria operation as well as to increase patron satisfaction.

The Central Information And Control System

Figure 14:
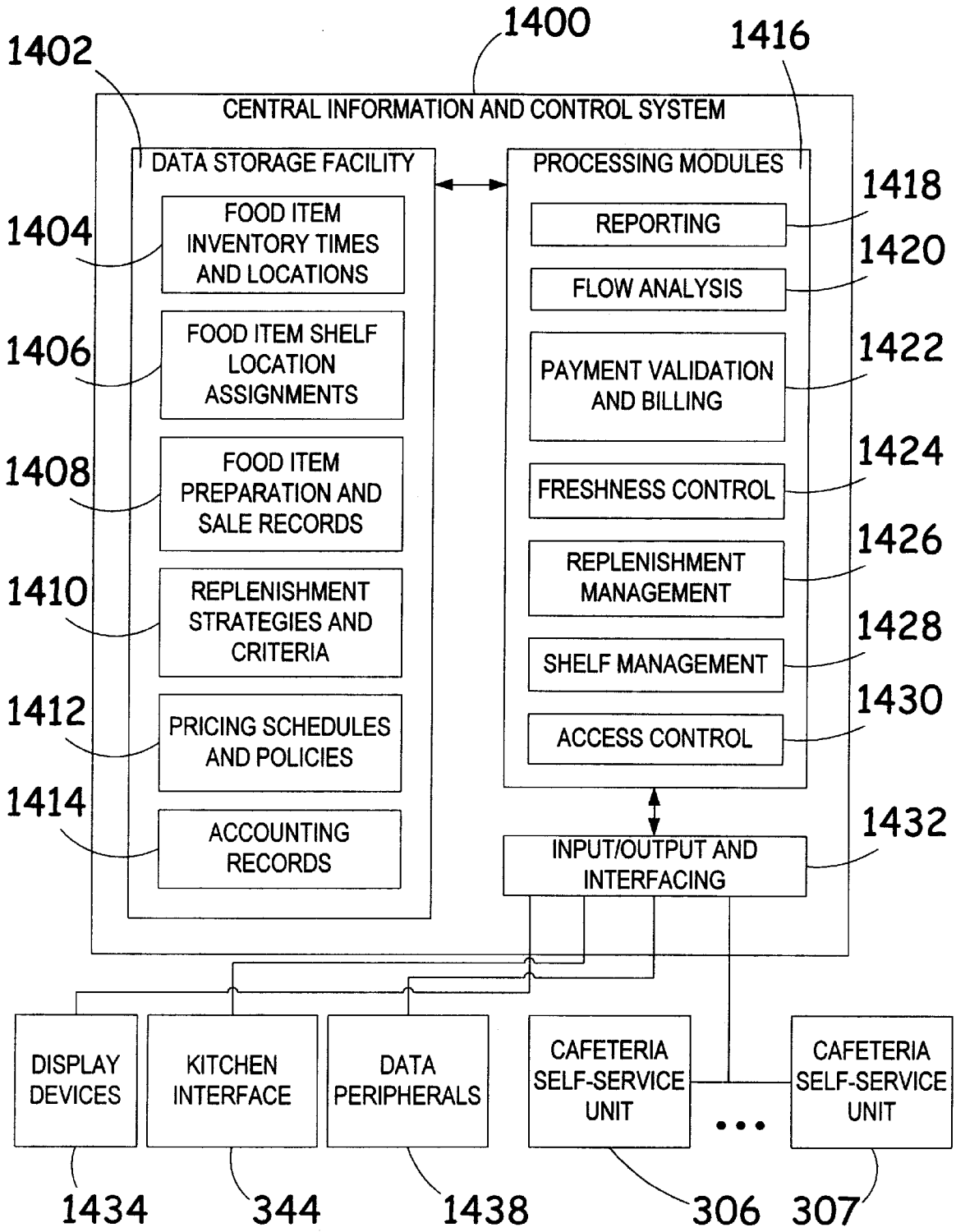
FIG. 14 shows the data storage and processing module components of a central information and control system according to the present invention.

FIG. 14 illustrates the components of a central information and control system according to the present invention. A central information and control system 1400 contains a data storage facility 1402 which stores tables and records of information for the operation of the cafeteria self-service system, including such data items as:

- A food item inventory times and locations data block 1404, for holding the times of replenishment and the location of each food item in the cafeteria self-service units. In addition, food item inventory times and locations data block 1404 can also hold a table of the maximum time-on-shelf permitted for the various food items.
- A food item shelf location assignments data block 1406, for holding the specific food item in each division of the cafeteria self-service units.
- A food item preparation and sale records data block 1408, for holding records of the specific food items prepared and sold.
- A replenishment strategies and criteria data block 1410, for holding parameters governing the replenishment of food items purchased by patrons according to a selected replenishment management mode, as described in detail below.
- A pricing schedules and pricing policy data block 1412, for holding pricing of food items, including combination pricing, time-varying pricing, specials, and so forth.
- An accounting records data block 1414, for holding accounting records, such as patron billing records. Central information and control system 1400 also contains a set of processing modules 1416, which includes:
- A reporting module 1418, for generating management reports, patron receipts, and so forth.
- A flow analysis module 1420 for analyzing food item preparation and purchasing patterns.
- A payment validation and billing module 1422 for validating payment cards and billing purchased food items thereto and for use with food item preparation and sale records data block 1408, accounting records data block 1414, and an access control module 1430. Payment validation and billing module 1422 is linked via an input/output and interfacing device 1432 to one or more payment card accepting devices 209 (FIG. 2) to form a component of an automated payment handler, as described below and shown in FIG. 15.

A freshness control module 1424 for tracking the latency times of food items in cafeteria self-service units for use with food item inventory times and locations data block 1404.

A replenishment management module 1426 for use with replenishment strategies and criteria data block 1410.

A shelf management module 1428 for use with food item inventory times and locations data block 1404 and food item shelf location assignments data block 1406.

Access control module 1430, for controlling patron access to cafeteria self-service units and receiving access status information therefrom. Access control module 1430 is linked via input/output and interfacing device 1432 to one or more physical devices which can selectively bar or allow access by patrons to the food items in the cafeteria self-service units. As previously discussed herein, there are many different ways to physically control patron access. As a non-limiting example, in a preferred embodiment of the present invention, access control module 1430 is linked via input/output and interfacing device 1432 to one or more automatic locking devices 225 and door sensing devices 227 (FIG. 2) to be a component of an access controller as described below and illustrated in FIG. 16.

Central information and control system 1400 also contains input/output and interfacing device 1432 for linking to a set of display devices 1434; kitchen interface 344 (as also shown in FIG. 3); a set of data peripherals 1438, including, but not limited to devices such as printers, off-line data storage units, modems, and manager's console 322 (FIG. 3); and one or more cafeteria self-service units 306 and 307 (as also shown in FIG. 3). The ellipsis . . . indicates that additional cafeteria self-service units may be included in the link with central information and control system 1400.

A set of display devices 1434 including devices such as patron display 334 (FIG. 3) and staff personnel display 328 (FIG. 3) and interactive touch-sensitive displays as previously discussed for input of food item locations.

A kitchen, such as the combination of kitchen equipment 340 (FIG. 3), kitchen interface 344 (FIG. 3), and link 345 (FIG. 3) as previously described.

A set of data peripherals 1438, including external devices such as manager's console 322 (FIG. 3), printers, data storage devices, modems, and so forth.

A set of cafeteria self-service units containing at least one cafeteria self-service unit as described herein.

Within central information and control system 1400, processing modules 1416 communicates with data storage facility 1402 and with input/output and interfacing device 1432, as shown in FIG. 14.

The Automated Payment Handler and the Purchase Cycle

Figure 15:
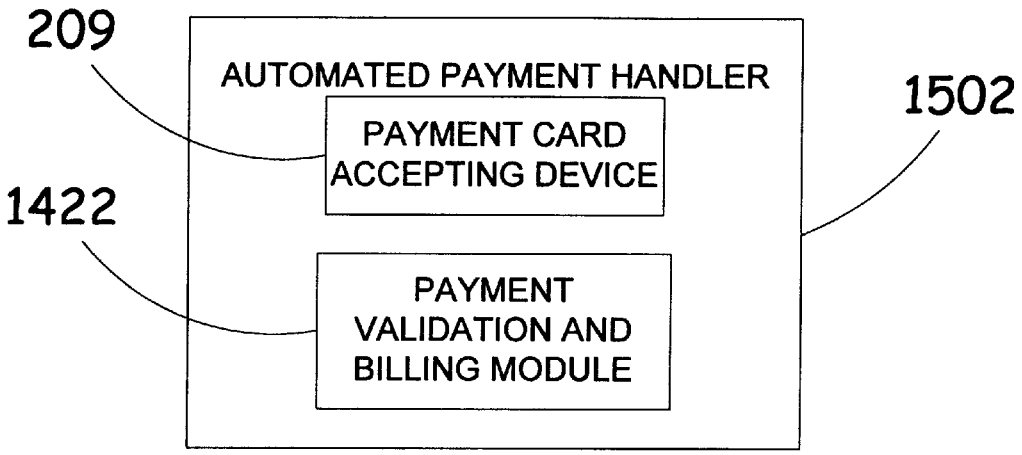
FIG. 15 shows the components of an automated payment handler according to the present invention.

FIG. 15 shows the components of an automated payment handler 1502, which includes a payment card accepting device 209 and a payment validation and billing module 1422. These components may be physically separate and may be connected by suitable communication links. For example, in a preferred embodiment of the present invention, payment validation and billing module 1422 is part of central information and control system 1400 interfaced via input/output and interfacing device 1432 (FIG. 14) to payment card accepting device 209, which is physically part of cafeteria self-service unit 206 (FIG. 2).

An automated payment handler according to the present invention activates the payment card accepting device to receive a presented payment card from a patron and validates the payment card. The process of validation involves checking the payment card as being eligible for making payment. If the payment card is eligible for making payment, the payment card is a valid payment card. Otherwise, if the payment card is not eligible for making payment, the payment card is not a valid payment card. If the payment card is valid, the automated payment handler notifies a central information and control system, and is then activated thereby to charge the payment card for the food items taken by the patron according to a determined price for the food items plus applicable other costs, such as tax. Consequently, the automated payment handler must be able to charge the payment card a variable amount calculated or selected according to certain criteria. For example, the amount of the charge is normally the sum of the prices of the individual food items taken by the patron. However, there may be special pricing in effect, such as illustrated in FIG. 7, where the price of an entree includes the price of two side orders (708). Other discounts and special offers may also be in effect, and would be taken into account by the automated payment handler. The automated payment handler furthermore notifies the central information and control system that a valid payment card has been presented, thereby initiating the purchase cycle. In turn, the automated payment handler is selectively activated by the central information and control system to charge the payment card.

FIG. 12 illustrates the purchase cycle, which shows how the various elements of the present invention work together In the illustrated purchase cycle, patron 208 approaches cafeteria self-service unit 206 and presents payment card 207 to payment card accepting device 209 (FIG. 2). Up to this time, cafeteria self-service system is in an idle state 1202, and is ready to handle a purchase transaction. At a step 1204 the patron presents payment card 207, which is then validated by automated payment handler 1502 (FIG. 15). At a decision point 1206, if payment card 207 is not valid, the transaction is rejected at a step 1208, and at a step 1210 the transaction is completed, and the cafeteria self-service system returns to idle state 1202. If, however, payment card 207 is valid, the central information and control system of the cafeteria self-service system receives notification from the automated payment handler that a valid payment card has been presented, and activates access controller 1602 (FIG. 16) in a step 1212, to allow the patron free access to food items in the cafeteria self-service unit. At a decision point 1214, the cafeteria self-service system determines if the patron's purchase is completed. There are various conditions which indicate that the purchase is completed, including, but not limited to, patron 208 removing payment card 207 from being presented to payment card accepting device 209, patron 208 taking of all available food items from the shelves to which he has been granted access, and patron 208 closing of patron access door 210 (FIG. 2) as detected by door sensing device 227. If the purchase is completed, in a step 1218 the cafeteria self-service system activates access controller 1602 to bar access to the food items, and then completes the transaction in step 1210 before returning to idle state 1202. If, however, the purchase is not completed, the cafeteria self-service system senses a removed food item in a step 1216 and notifies kitchen 204 (FIG. 2) that this food item has been removed, in a step 1220. The notification of kitchen 204 that the food item has been removed can be done in many different ways, depending on the management preferences. For example, a visual display and/or automatic audio announcement could be made in kitchen 204 that the removed food item needs to be replenished. The notification to the kitchen could also consist simply of the updating of a display showing the total of remaining food items, such as illustrated in FIG. 6. Following this, in a step 1222 the removed food item is recorded by central information and control system 1400. At this point, the cafeteria self-service system returns to decision point 1214 to await the removal of further food items or the completion of the purchase.

A payment card is considered valid if capable of paying for the entire contents of the compartment to which the patron gains access. A payment card is considered to be invalid otherwise. This is because the patron is free to take as many food items as he or she wishes without restriction off the shelves of the cafeteria self-service unit, once the access controller permits access to those shelves.

Access Control

The system according to the present invention includes an access controller to restrict, or "bar", access by patrons to the cafeteria self-service unit. The preferred embodiments disclosed herein utilize a patron access door with an automatic locking device and a door sensing device as the physical components of an access controller, but it is understood that such a patron access door is a non-limiting example of the physical components of an access controller.

The term "access control" herein denotes any means of automatically and selectively barring or allowing physical access by patrons to food items in the cafeteria self-service units. Access control thus has two aspects:

1. The logical determination of whether to bar physical access by a specific patron to the food items of a cafeteria self-service unit, or to allow physical access by that specific patron to the food items of the cafeteria self-service unit. The terms "selectively barring or allowing" herein denotes such a logical determination. The access controller according to the present invention makes such a logical determination of when to allow access and when to bar access.
2. The implementation of physical means to effect such barring or allowing of access by the patron to the food items of the cafeteria self-service unit. The term "physical access control" herein denotes such physical means. The access controller according to the present invention activates the physical access control means.

Figure 16:
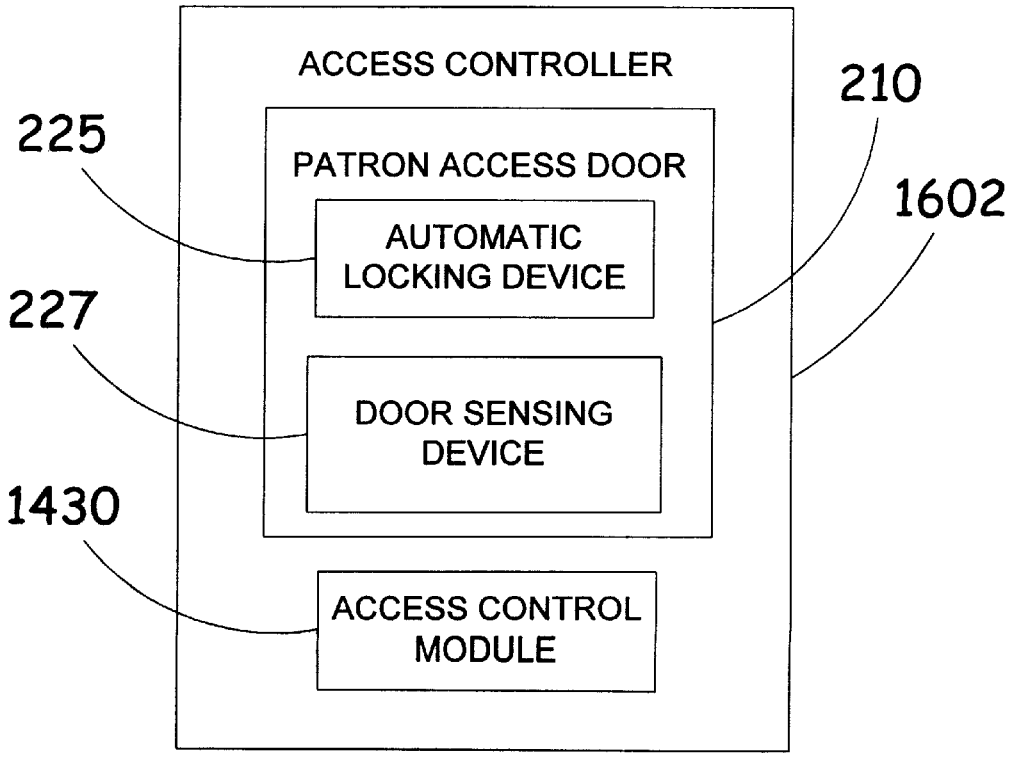
FIG. 16 shows the components of a non-limiting example of an access controller according to the present invention.

Selectively barring is implemented by access control module 1430 of central information and control system 1400 (FIG. 14). Physical access control, as previously discussed, may take many forms, and as a non-limiting example in a preferred embodiment of the present invention, physical access control is effected by means of patron access door 210 in conjunction with automatic locking device 225 and door sensing device 227 (FIG. 2). Thus, FIG. 16 shows this non-limiting example of an access controller 1602 including as components access control module 1430 (also shown in FIG. 14) and patron access door 210, which includes automatic locking device 225 and door sensing device 227 (also shown in FIG. 2).

Physical access control can be implemented in various ways. In a preferred embodiment of the present invention, physical access control is implemented by patron access door 210 in conjunction with automatic locking device 225 and door sensing device 227 (FIG. 2). This is a non-limiting example of selectively barring the patron from the food items in the cafeteria self-service unit, by selectively obstructing the patron, such that the patron may be completely prevented from being able to reach or touch the food items. The term "obstructionary access control" herein denotes such selective complete obstructing of the patron. Obstructionary access control means include, but are not limited to, doors, covers, panels, and other such devices which act to completely separate the patron from the food items, in conjunction with some form of automatic locking device to enable selectivity. Obstructionary access control has the disadvantage of being somewhat obtrusive and slow. However, obstructionary access control has the advantage of offering reasonable security, along with the benefit of environmental protection of food items, such as food items which must be kept cold or warm, or for food items which should not be exposed to air currents and possible airborne contaminants.

In another preferred embodiment of the present invention, physical access control is implemented by some form of selective notification to the patron when access to the food items is permitted and when access to the food item is not permitted, but without completely obstructing the patron from the food items. Because the food items are not completely separated from the patrons, the effectiveness of such a selective barring requires the compliance of the patrons. The term "compliant access control" herein denotes such physical access control relying on patron cooperation. Examples of compliant access control include, but are not limited to, lights, audio alarms, and gates or other devices which in some manner notify patrons not to take food items, but which do not completely prevent patrons from reaching food items. The purpose of such a gate would be principally visual. Various such devices could be used in conjunction with one another. As a non-limiting example of compliant access control, a raised gate and a green light could be used to visually notify the patron that he or she is allowed to take food items, while a lowered gate and red light could be used to visually notify the patron that he or she is barred from taking food items from the cafeteria self-service unit. In conjunction with these visual notifications, an alarm could be sounded if someone attempted to reach over the gate to take a food item, despite being notified that he or she is barred from doing so. Such an alarm could, in another non-limiting example, be received only in the kitchen. In minimal form, as a further non-limiting example, compliant access control can be a sign or other advisory notifying the patrons to present their payment cards before taking any food items, because this has the effect of notifying the patrons that they are barred from taking food items until presentation of their payment cards. Compliant access control has the disadvantage of needing to rely on patron cooperation with the intended selective allowing or barring of access. However, compliant access control is also less obtrusive than obstructionary access control, and can therefore be designed to allow faster and more convenient access to the food items, in addition to being more hospitable to the patrons.

In still another embodiment of the present invention, the patron access door is opened and closed automatically via an automatic door operating device upon presentation of a valid payment card. For example, the payment card may be a contactless RF smart card, which provides the ability to conduct transactions at a small distance. When the patron carries the payment card near a cafeteria self-service unit, such as by keeping the payment card in a special slot in the cafeteria tray while making selections (as illustrated in FIG. 2 for payment card 207 in tray 205), the payment card accepting device senses the patron's proximity and the cafeteria self-service system signals the automatic door operating device to open the door of the cafeteria self-service unit. The automatic door opening could also be initiated by the scanning of an identification badge worn by the patron.

Shelf Management

Shelf management concerns the management of food items contained within the cafeteria self-service units. Specifically, shelf management involves:

1. the assignment and reassignment of space in the cafeteria self-service units for specific food items; and
2. the tracking of the movement of food items into and out of the cafeteria self-service units.

The assignment of space in the cafeteria self-service units can be accomplished from a predetermined list (in data storage, such as in a central information and control system) by which shelf divisions (as designated in FIG. 4, and described elsewhere herein) are assigned to have specific types of food items on them. Alternatively, in a preferred embodiment of the present invention, shelf divisions can be reassigned dynamically by staff personnel. For example, an interactive touch-sensitive display located in the back of the cafeteria self-service unit could display, for each division, the food item assigned to that division. (The term "back" herein denotes the direction of the cafeteria self-service unit accessed by the staff personnel.) If the system instructs a staff person to place a different food item in that division, the staff person could indicate the completion of this instruction by confirming the new food item in that division via the interactive touch-sensitive display. The system would then update internal data storage to reflect the new food item location.

Proper correlation of food items with division is important for several reasons. First, the central information and control system must have up-to-date information on the allocation of cafeteria self-service unit space for food items. Second, certain item sensing devices may be able to identify that a food item has been placed or removed at a particular division, but may not necessarily have the means to independently determine precisely what the food item is. The central information and control system would therefore determine the identity of a food item according to the division in which it is located.

Figure 13:
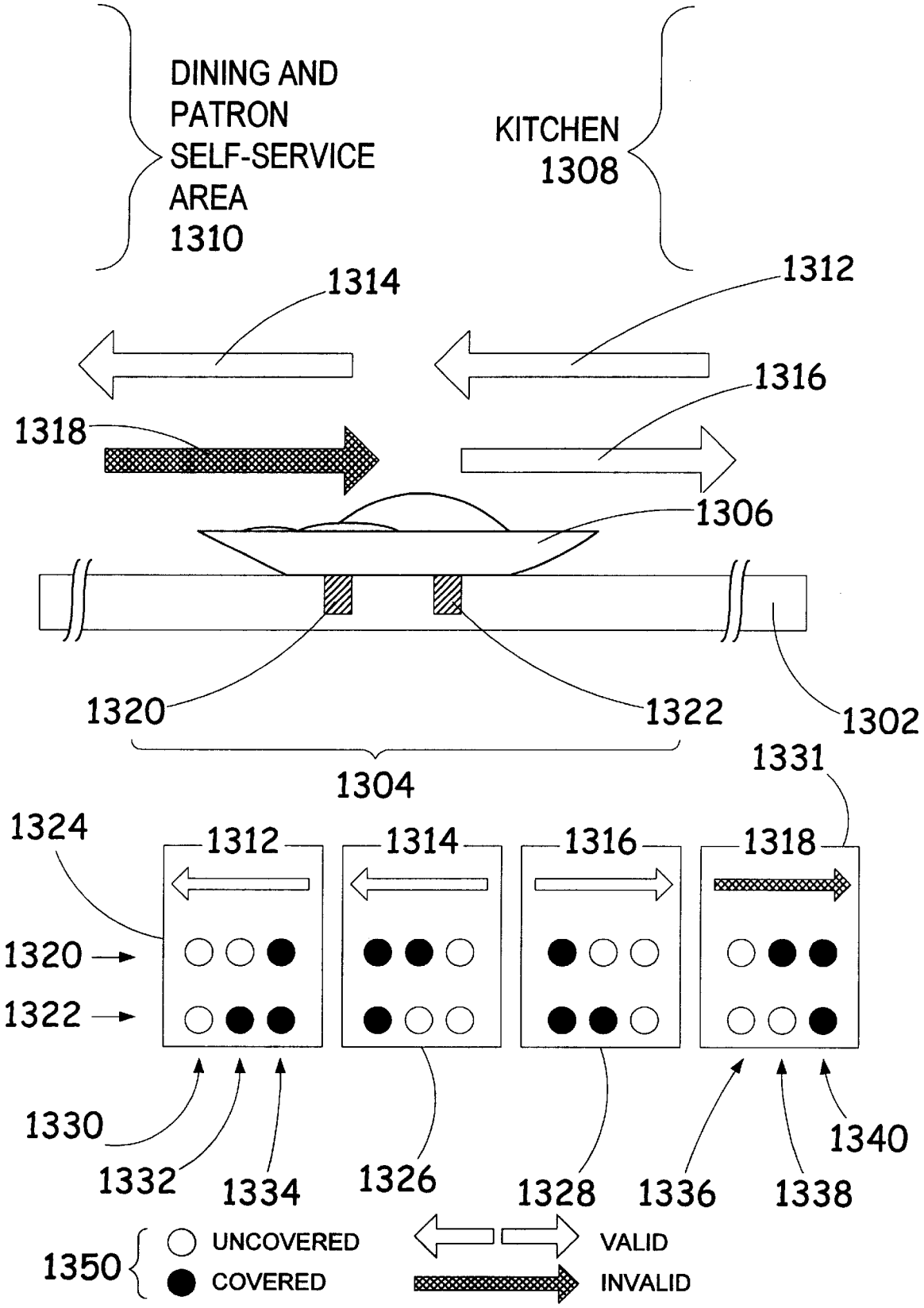
FIG. 13 shows how the direction of placement of a food item onto a shelf and the direction of removal of a food item off of a shelf may be automatically determined.

The other aspect of shelf management concerns the tracking of movement of food items into and out of the various divisions. As noted previously, each division has an item sensing device. FIG. 13 illustrates a configuration for an item sensing device that can determine the directional motion of a food item with respect to the cafeteria self-service unit. That is, the item sensing device can determine not only the presence, removal, and replacement of a food item, but also distinguishes whether the food item is removed or replaced via the front of the cafeteria self-service unit or via the back of the cafeteria self-service unit.

FIG. 13 shows a shelf 1302 with a division 1304 in which is located a front sensor 1320 closer to a dining and patron self-service area 1310, and a back sensor 1322 closer to a kitchen 1308. A food item 1306 is shown covering both front sensor 1320 and back sensor 1322. There are four different directional motions noted for a food item. A valid placement directional motion 1312 indicates the placement (or replacement) of food item 1306 from kitchen 1308 by a staff person. A valid patron removal directional motion 1314 indicates the removal for purchase of food item 1306 by a patron in dining and patron self-service area 1310. A valid staff person removal directional motion 1316 indicates the removal of food item 1306 by a staff person in kitchen 1308 (such as the removal of a food item for freshness control purposes). And an invalid patron replacement directional motion 1318 indicates the replacement of food item 1306 by a patron in dining and patron self-service area 1310. Patron replacement directional motion 1318 is not valid because it is not permitted for a patron to replace a food item removed from the cafeteria self-service unit. Once a patron removes a food item from the cafeteria self-service unit, the patron is charged for that food item. If there is a problem with that food item, the patron must bring it to the attention of the cafeteria management, who can make the proper adjustment. The patron's direct replacement of a food item will not cancel the charge for that food item. Moreover, it is desirable to prohibit such replacement for hygienic reasons. Consequently, it is desired to be able to detect attempts at making such replacement and notify the patron that this is not permitted, such as by sounding an alarm. If the replaced food item remains, the system should notify the management immediately so that the problem can be dealt with.

FIG. 13 shows how the different directional motions are distinguished automatically in a set of four boxes illustrating the time sequence of covering and uncovering of front sensor 1320 and back sensor 1322 for each direction, according to a legend 1350. A box 1324 illustrates the sequence for directional motion 1312. Initially, a column 1330 shows that both front sensor 1320 and back sensor 1322 are uncovered. Next, a column 1332 shows that front sensor 1320 is uncovered, but back sensor 1322 is covered. Finally, a column 1334 shows that both front sensor 1320 and back sensor 1322 are covered. As another example, a box 1331 illustrates the sequence for the (invalid) directional motion 1318, which is the reverse of (valid) directional motion 1312. Initially, a column 1336 shows that both front sensor 1320 and back sensor 1322 are uncovered. Next, a column 1338 shows that front sensor 1320 is covered, but back sensor 1322 is uncovered. Finally, a column 1340 shows that both front sensor 1320 and back sensor 1322 are covered. Likewise, a box 1326 illustrates the sequence for directional motion 1314, and a box 1328 illustrates the sequence for directional motion 1316. It will be appreciated that the sequences illustrated in each of the boxes is unique, and therefore it is possible to automatically distinguish the directional motions using logical processing means which are well-known in the art.

Replenishment Management

An automated cafeteria according to the present invention may be operated in one of several different modes, depending on the preference of the management. These modes concern the manner of making the selections of which food items to prepare for placement in the cafeteria self-service units, and may be influenced by the present inventory of ingredients for preparing food items. The replenishment criteria, which determine the specific food items placed in the cafeteria self-service units, are thus governed by the selected mode.

1. Push Mode: In the "push mode", the selection of which food items and quantities thereof to prepare and place in the cafeteria self-service units is made according to available inventory of the prepared food items and/or their ingredients. For example, if there are the ingredients to prepare a certain number of servings of a particular entre, then in the push mode, that particular entre will be prepared and placed into the cafeteria self-service unit as needed to replenish the supply in the cafeteria self-service unit. In the push mode, cafeteria self-service units for the relevant food items are allocated in advance for those food items, but may be reallocated after those food items have been sold.
2. Pull Mode: In the "pull mode", the selection of which food item types and quantities thereof to prepare and place in the cafeteria self-service units is made according to the preferences of the patrons, as determined by the food item types purchased from the cafeteria self-service units. For example, if there are ingredients to prepare a number of different entrees, then in the pull mode, several of those different entrees will be prepared and replenished according to patron demand as reflected in patron purchases. In the pull mode, cafeteria self-service units for the relevant food item types are allocated dynamically according to patron demand. A particular food item type might have a certain amount of space in the cafeteria self-service units allocated, but patrons might be favoring to purchase another food item type with a smaller allocated space in the cafeteria self-service units. In the pull mode, space in the cafeteria self-service units for the less popular food item type would be dynamically reallocatable to hold the more popular food item type.

3. Static Mode. In the "static mode", the selection of which food items and quantities thereof to prepare and place in the cafeteria self-service units is made according to a fixed predetermined list.

In any of the above modes, food items which are less popular with the patrons can be automatically repriced as a special offer to encourage patrons to purchase them.

Furthermore, certain food items that do not need to be prepared in the kitchen can be loaded into the cafeteria self-service unit during off-peak times, and their inventories maintained in way that is independent of the kitchen. For example, beverages such as canned or bottled soft drinks, or packaged snack food items (chips, pretzels, etc.) can be loaded into the cafeteria self-service unit and maintained by an outside firm under contract. In this regard, such food items are loaded into the cafeteria self-service unit in a manner similar to that for a free-access vending machine. An advantage of this arrangement is that there will be less demand on staff personnel in the kitchen, who are thereby free from having to maintain the inventory of such beverages, and can therefore devote better effort to maintaining food items that require preparation and immediate attention. The service access point for such food items can be directly from the kitchen, or it can be from the front of the cafeteria self-service unit as in a conventional vending system, if the replenishment occurs during non-operating hours, when it would cause no interference with the patrons.

Freshness Control

Freshness control refers to the tracking and replacement of food items to insure that every food item remains in the cafeteria self-service units only within an acceptable time limit for that food item. Food items that remain unpurchased past a specified expiration time for each food item type are identified by the system and flagged for removal or replacement by a fresh food item. The division location and shelf time of each food item in the cafeteria self-service units is maintained by the central information and control system, and when a specific food item requires removal or replacement, the system notifies staff personnel via a staff personnel display of the division and food item type needing removal or replacement, along with a directive for the appropriate action.

Flow Analysis

A flow analysis module analyzes the patterns in time of food item preparation operation 342, replenishment operation 310, and selection operation 314, and makes the statistics and summaries of these patterns available to central information and control system 320 (all illustrated in FIG. 3). The flow analysis assists in appropriate planning for the following goals:

avoiding shortages of popular food items, which would result in patron disappointment and lost revenues;

avoiding overproduction of food items, which would result in spoilage and waste;

optimal staff personnel allocation for efficient handling of peak loads.

While the present invention has been described with respect to a limited number of embodiments, it will be appreciated that many further variations, modifications and other applications of the present invention may be made.

What is claimed is:

1. A cafeteria self-service system for displaying and selling a plurality of food items supplied from a kitchen to a plurality of patrons, each patron having a payment card; the cafeteria self-service system comprising:

(a) at least one cafeteria self-service unit for the storage and display of said food items, said at least one cafeteria self-service unit being accessible via a first direction from the kitchen and being accessible via a second direction by the patrons, said cafeteria self-service unit including:

(i) physical access control means for selectively barring or allowing physical access by the patrons to the food items in said cafeteria self-service unit via said second direction;

(ii) at least one item sensing device for determining food items placed in said cafeteria self-service unit via said first direction and for determining food items removed from said cafeteria self-service unit via said second direction;

(iii) a payment card accepting device for accepting payment cards presented by patrons;

(b) an access controller for determining when to allow access and when to bar access, and for activating said physical access control means;

(c) an automated payment handler for activating said payment card accepting device, validating the payment card, and charging the payment card a selectable amount;

(d) a data storage facility storing therein:

(i) a pricing schedule for said food items; and (ii) food item replenishment criteria to determine a required amount of food items to be supplied to said cafeteria self-service unit via said first direction;

(e) a kitchen interface for directing food item preparation operations;

(f) a central information and control system interfacing with said access controller, said automated payment handler, said item sensing device, said data storage facility and said kitchen interface; for:

(i) receiving notification from said automated payment handler that a valid payment card has been presented;

(ii) activating said access controller to allow patron access to said at least one cafeteria self-service unit via said second direction;

(iii) receiving from said item sensing device the identity of each food item removed from said cafeteria self-service unit via said second direction;

(iv) calculating said required amount of food items to be supplied to said cafeteria self-service unit via said first direction in accordance with said food item replenishment criteria, and activating said kitchen interface to exhibit said required amount; and (v) selectively activating said automated payment handler to charge said valid payment card.

2. The cafeteria self-service system as in claim 1, wherein said at least one cafeteria self-service unit is a plurality of cafeteria self-service units, and wherein said central information and control system is linked to each cafeteria self-service unit.

3. The cafeteria self-service system as in claim 1, wherein said replenishment criteria are governed by a static mode, wherein food items are selected for placement in said cafeteria self-service unit according to a fixed predetermined list.

4. The cafeteria self-service system as in claim 1 wherein said replenishment criteria are governed by a pull mode, wherein food items are selected for placement in said cafeteria self-service unit according to the purchases of the patrons.

5. The cafeteria self-service system as in claim 1, wherein said cafeteria self-service unit includes a plurality of divisions for placing food items, the food items selectable from a plurality of food item types, the cafeteria self-service system furthermore comprising a staff personnel console device for indicating the food item type placed in a division.

6. The cafeteria self-service system as in claim 1, wherein said kitchen interface comprises a staff personnel display means to exhibit said required amount of food items.

7. The cafeteria self-service system as in claim 5 wherein said data storage facility furthermore stores an expiration time for each of said food item type and a shelf time of the food item in each of said divisions.

8. The cafeteria self-service system as in claim 1, wherein said item sensing device furthermore determines the directional motion of a food item, to distinguish between a food item removed via said first direction from a food item removed via said second direction, and between a food item placed via said first direction from a food item placed via said second direction.

9. The cafeteria self-service system as in claim 1, furthermore comprising a patron display, to inform patrons of the available food items and prices.

10. The cafeteria self-service system as in claim 1 wherein said physical access control means comprises obstructionary access control, wherein patrons are obstructed from the food items in said cafeteria self-service unit.

11. The cafeteria self-service system as in claim 1 wherein said physical access control means comprises compliant access control, wherein patrons are notified when access to the food items is permitted and when access to the food items is not permitted.

12. The cafeteria self-service system as in claim 1, wherein the food items are of a plurality of food item types, and wherein said cafeteria self-service unit has space which is dynamically reallocatable from a first food item type to a second food item type.

13. The cafeteria self-service system of claim 1 wherein said cafeteria self-service unit furthermore comprises a plurality of service access points for independent replenishment of food items.

14. The cafeteria self-service system of claim 13, wherein said cafeteria self-service unit furthermore comprises a compartment accessible via said second direction under said access controller and has a service access point selected from the group consisting of said first direction and said second direction.

15. A method for operating an automated cafeteria, the automated cafeteria serving a plurality of patrons, each patron having a payment card for making purchases, the automated cafeteria including:

a cafeteria self-service unit for displaying and selling a plurality of food items supplied from a kitchen via a first direction;

physical access control means for selectively baring access by the patrons to the food items in the cafeteria self-service unit via a second direction;

at least one item sensing device for determining food items removed via the second direction; and a payment card accepting device for accepting payment cards presented by patrons;

the method comprising the steps of:

(a) accepting a presented payment card from a patron to begin a purchase;

(b) validating said presented payment card;

(c) activating, if said presented payment card is valid, the physical access control means to allow the patron access to the food items;

(d) receiving a notification from the item sensing device that a purchased food item has been taken from the cafeteria self-service unit via the second direction;

(e) charging said presented payment card according to said purchased food item; and (f) activating, upon completion of said purchase, the physical access control means to bar access to the food items by patrons via the second direction.

16. The method of claim 15, the automated cafeteria further including a kitchen interface for directing food item supply operations, the method further comprising the step of:

(a) activating, upon receiving said notification, the kitchen interface to direct replenishment of said purchased food item.

* * * * *